US010879611B2

(12) United States Patent
Sugimoto et al.

(10) Patent No.: US 10,879,611 B2
(45) Date of Patent: Dec. 29, 2020

(54) ANTENNA DEVICE

(71) Applicants: DENSO CORPORATION, Kariya (JP); National University Corporation Kyoto Institute of Technology, Kyoto (JP)

(72) Inventors: Yuji Sugimoto, Nisshin (JP); Masakazu Ikeda, Nisshin (JP); Shiro Koide, Kariya (JP); Tetsuya Ueda, Kyoto (JP); Shuhei Terada, Kyoto (JP)

(73) Assignees: DENSO CORPORATION, Kariya (JP); National University Corporation Kyoto Institute of Technology, Kyoto (JP)

( * ) Notice: Subject to any disclaimer, the term of this patent is extended or adjusted under 35 U.S.C. 154(b) by 27 days.

(21) Appl. No.: 16/143,718

(22) Filed: Sep. 27, 2018

(65) Prior Publication Data

US 2019/0103676 A1 Apr. 4, 2019

(30) Foreign Application Priority Data

Sep. 29, 2017 (JP) ..... 2017-189879

(51) Int. Cl.
*H01Q 9/04* (2006.01)
*H01Q 1/38* (2006.01)
(Continued)

(52) U.S. Cl.
CPC ..... *H01Q 9/0407* (2013.01); *H01Q 1/32* (2013.01); *H01Q 1/38* (2013.01); *H01Q 1/42* (2013.01); *H01Q 5/10* (2015.01); *H01Q 7/00* (2013.01); *H01Q 9/0457* (2013.01); *H01Q 9/0464* (2013.01); *H01Q 21/065* (2013.01)

(58) Field of Classification Search
CPC .. H01Q 9/0407; H01Q 9/0457; H01Q 9/0464; H01Q 9/0471; H01Q 9/0428;
(Continued)

(56) References Cited

U.S. PATENT DOCUMENTS 5,917,450 A * 6/1999 Tsunekawa ..... H01Q 9/0414 343/700 MS
7,911,386 B1 3/2011 Itoh et al.
(Continued)

FOREIGN PATENT DOCUMENTS

JP 2011244136 A 12/2011
JP 2015231104 * 12/2015
WO WO2019058378 * 9/2017

*Primary Examiner* — Awat M Salih
(74) *Attorney, Agent, or Firm* — Harness, Dickey & Pierce, P.L.C.

(57) ABSTRACT

An antenna device includes a ground plate, a patch section parallel to, and spaced apart from, the ground plate, a first short circuit section having a plurality of first conductive elements that electrically connect the patch section and the ground plate, and a second short circuit section having a plurality of second conductive elements electrically connected at one end to the ground plate. The plurality of first conductive elements are arranged in a circle with a first radius from a patch center point and provide a preset inductance. The plurality of second conductive elements are arranged in a circle with a second radius from the patch center point and provide a preset inductance.

9 Claims, 13 Drawing Sheets

(51) Int. Cl.

| | |
|---|---|
| ***H01Q 1/42*** | (2006.01) |
| ***H01Q 7/00*** | (2006.01) |
| ***H01Q 1/32*** | (2006.01) |
| ***H01Q 21/06*** | (2006.01) |
| ***H01Q 5/10*** | (2015.01) |

(58) Field of Classification Search
CPC ..... H01Q 9/0414; H01Q 5/10; H01Q 21/065; H01Q 1/32; H01Q 1/42; H01Q 1/38; H01Q 1/523; H01Q 19/005
See application file for complete search history.

(56) References Cited

U.S. PATENT DOCUMENTS 8,810,455 B2 * 8/2014 Achour ..... H01Q 21/065 343/700 MS
2004/0183735 A1 * 9/2004 Jecko ..... H01Q 9/0421 343/725
2008/0204326 A1 * 8/2008 Zeinolabedin ..... H01Q 9/0414 343/700 MS
2012/0268347 A1 * 10/2012 Tatarnikov ..... H01Q 9/0407 343/893
2014/0097990 A1 * 4/2014 Aboush ..... H01Q 9/0435 343/700 MS
2014/0266959 A1 * 9/2014 Xue ..... H01Q 1/38 343/848
2015/0123869 A1 * 5/2015 Bit-Babik ..... H01Q 19/10 343/857
2017/0237171 A1 * 8/2017 Kim ..... H01Q 9/0442 343/850
2017/0352960 A1 * 12/2017 Zhang ..... H01Q 9/0492
2018/0191073 A1 * 7/2018 Celik ..... H01Q 1/38
2018/0205151 A1 * 7/2018 Celik ..... H01Q 9/0435
2018/0277946 A1 * 9/2018 Murata ..... H01Q 1/38

* cited by examiner

ANTENNA DEVICE

CROSS REFERENCE TO RELATED APPLICATION

The present application is based on and claims the benefit of priority of Japanese Patent Application No. 2017-189879, filed on Sep. 29, 2017, the disclosure of which is incorporated herein by reference.

TECHNICAL FIELD

The present disclosure generally relates to an antenna device having a plate shape.

BACKGROUND INFORMATION

U.S. Pat. No. 7,911,386, i.e., patent document 1, discloses (i) a plate-shape metal conductor serving as a ground plate and (ii) a plate-shape metal conductor serving as a patch section, facing the ground plate and having a power feeding point at an arbitrary position. The ground plate and the patch section are electrically connected by a short circuit section to form an antenna device.

The antenna device in such configuration causes a parallel resonance at a certain frequency that is defined by (i) a capacitance formed in between the ground plate and the patch section and (ii) an inductance of the short circuit section. The capacitance of the space between the ground plate and the patch section is set according to (i) the area size of the patch section and (ii) the distance between the ground plate and the patch section. Further, the inductance of the short circuit section is set according to a radius of the short circuit section.

Therefore, by adjusting the area size of the patch section and/or the radius of the short circuit section, a frequency to be transmitted and received by the antenna device is set to a desired value. Patent document 1 discloses a configuration of the antenna device, in which the antenna device includes a plurality of patch units respectively made up from a combination of a patch section and a short circuit section arranged at a preset cycle (i.e., a cycle of such combinations).

The antenna device may be configured to be operable at two or more frequencies, if the antenna includes respectively different patch units disposed on the substrate for each of the different frequencies. However, such a configuration may inevitably increase the size of the substrate to accommodate the respectively different patch units corresponding to each of the different frequencies to be transmitted and received, thereby leading to an increase of the overall volume of the antenna device.

SUMMARY

It is an object of the present disclosure to provide an antenna device that is operable at multiple frequencies without increasing its size or volume.

In an aspect of the present disclosure, an antenna device for receiving and transmitting a radio wave at a first frequency and a second frequency, where the second frequency is higher than the first frequency, may include: a ground plate, a patch section, a plurality of first conductive elements, a plurality of second conductive elements, and a plurality of capacitive elements. The ground plate may be a planar, or plate-shape, conductive member. The patch section may be a planar conductive member and may be disposed at a preset distance from and parallel to the ground plate. The patch section may have an edge part and a centrally disposed patch center point. The plurality of first conductive elements may be configured to electrically connect the patch section and the ground plate. The plurality of first conductive elements may be spaced at an equal distance from each other and arranged in a first circle with a first radius from the patch center point. The plurality of second conductive elements may be configured to electrically connect the patch section and the ground plate. The plurality of second conductive elements may be spaced at an equal distance from each other and arranged in a second circle with a second radius from the patch center point. The second radius may be greater than the first radius. The plurality of capacitive elements each may have a preset capacitance and may be disposed on an electric current path from the patch section to the ground plate.

The antenna device configured as described above may have two separate electric current paths for induced electric current, i.e., one path for the first frequency electric current and the other path for the second frequency electric current. Here, the second frequency may be a higher frequency than the first frequency. Thus, the antenna device may have two operation modes, that is, a first mode that may use the first conductive element as a main path of the electric current, and a second mode that may use the second conductive element as a main path of the electric current. That is, the antenna device may operate at the first frequency by using the first conductive element as the main path of the electric current, and may operate at the second frequency by using the second conductive element as the main path of the electric current.

The first mode of the antenna device at the first frequency is described first, in which the first conductive element may be used as the main/primary path for the electric current. When the electric current flows through the first conductive element, the plurality of first conductive elements that are equidistantly positioned on a circle of the first radius (i.e., radius R1) about a patch center point (i.e., a center point of the patch section) may operate or act as a pillar-like conductive member or pillar-shaped conductor with the radius R1 and may connect the patch center point and the ground plate. The pillar-shaped conductor having the radius R1 may provide an inductance corresponding to the radius R1. The induced conduction current in the antenna device may flow mainly on a "surface" of the pillar-shaped conductor e.g., on a side face of the pillar-shaped conductor, and an electromagnetic field hardly enters an "inside" area of the pillar-shaped conductor, that is, the electromagnetic field may not enter the "body" of the pillar-shaped conductor.

The electromagnetic field not entering the conductor body may make a portion of the patch section outside the circle of radius R1 together with the ground plate serve as a capacitor. That is, a space between the patch section outside the circle of radius R1 and the ground plate may form a capacitor with its capacitance defined according to the size of the area and according to the distance between the patch section and the ground plate. Further, an LC series resonance circuit may be made up of (i) the second conductive elements on the circle of radius R2 and (ii) the capacitive element that may operate as an element that provides a capacitive reactance at a frequency lower than the resonant frequency of the LC series resonance circuit.

Thus, the above reasoning may be summarized as follows. That is, when the antenna device operates by using the first conductive elements as the main electrical current path, the behavior of the antenna device may be understood as a parallel connection of (i) an inductance provided by the pillar-shaped conductor having a radius R1, (ii) a capacitance provided by a part of the patch section outside the circle of radius R1 and the ground plate, and (iii) a capacitance of the LC series (resonance) circuit. That is, the parallel resonance is caused in the antenna device at a frequency defined by those values, that is, by the inductance and the capacitances.

The second operation modes of the antenna device, in which the second conductive element may be used as a main/primary path of the electric current, is described next. When the electric current flows through the second conductive element, the plurality of second conductive elements (51) that are equidistantly positioned on a circle of radius R2 about the patch center point (i.e., a center point of the patch section) may operate or act as a pillar-shaped conductor with radius R2. The pillar-shaped conductor having a radius R2 may provide an inductance according to its radius R2. The induced conduction current in the antenna device may flow mainly on a "surface" of the pillar-shaped conductor, that is, on a side face, and an electromagnetic field barely enters an "inside" area of the pillar-shaped conductor. That is, the electromagnetic field may not enter the "body" of the pillar-shape conductor. As such, in the second operation mode where the second conductive elements are used as a main path of the electric current, the influence of the first conductive elements positioned on the circle of radius R1 may be negligible.

The electromagnetic field not entering the inside of the circle of radius R2 may make a portion of the patch section outside the circle of radius R2 serve as a capacitor together with the ground plate. That is, a space between the patch section outside the circle of radius R2 and the ground plate may form a capacitor with its capacitance defined according to the size of the area and the distance between the patch section and the ground plate. The plurality of capacitive elements providing the capacitances may be connected in parallel, and the second short circuit section providing an inductance may be connected to the plurality of capacitive elements in series.

Therefore, to summarize the above reasoning, when the second conductive element serves as a main path of the electric current for the operation of the antenna device, the behavior of the antenna device may be understood as a circuit having (i) an inductance provided by the pillar-shape conductor having a radius R2, (ii) a capacitance provided by a plurality of capacitive elements, and (iii) a capacitance provided by a part of the patch section outside of the circle of the radius R2 and the ground plate. That is, the parallel resonance may occur in the antenna device at a frequency defined by those values, that is, the inductance value and the two capacitance values. Therefore, the parallel resonance may be caused at a frequency that is defined by those values.

The radius R2 may be greater than the radius R1, which may make the inductance provided by the second conductive element behaving as the pillar-shaped conductor smaller than the inductance provided by the first conductive element behaving as the pillar-shaped conductor. The size of the area of the part of the patch section outside the circle of radius R2 may be smaller than the size of the area of the part of the patch section outside the circle of radius R1. As such, the capacitance of the "capacitor" made up from the patch section and the ground plate when the second conductive element serves as the main path of the electric current may be smaller than the capacitance of the "capacitor" made up from the patch section and the ground plate when the first conductive element serves as the main path of the electric current. In addition, the resonant frequency of a resonance circuit may be calculated as $1/2\pi\sqrt{(LC)}$.

Therefore, the resonant frequency of the antenna device that operates by using the second conductive elements as the main path of the electric current may be higher than the resonant frequency of the antenna device that operates by using the first conductive elements as the main path of the electric current. Further, the resonant frequency in each of the operation modes may be set to a target/desired value by adjusting the inductance and/or the capacitance of the first and second conductive elements.

Thus, based on the above configuration, two separate paths of the electric current may be provided for the operation of the antenna device at the first frequency and at the second frequency. As a result, the radio waves having the first frequency and having the second frequency may both be transmitted and received using the same (i.e., one) patch section. That is, the antenna device may be operable at different frequencies, without increasing the device size.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereafter, an embodiment of the present disclosure is described with reference to the drawings. The antenna device 1 of the present embodiment is configured to transmit and receive a radio wave of two predetermined frequencies, that is, a first frequency f1 and a second frequency f2, as described in the following paragraphs. The first frequency f1 and the second frequency f2 are independent, different frequencies. In other words, the second frequency f2 is set to an arbitrary value that can be set regardless of the first frequency f1. For example, the first frequency f1 may be set to 1.58 GHz and the second frequency f2 may be set to 3.78 GHz. For the ease of understanding the example frequencies in the description, of the two transmission/reception frequencies, the lower frequency corresponds to the first frequency f1.

The radio wave for transmitting/receiving the signals may have any frequency, for example, 760 MHz, 900 MHz, 1.17 GHz, 1.28 GHz, 1.55 GHz, 5.9 GHz. The antenna device 1 may be used for only one of transmission and reception. Since the transmission and reception of the radio wave are symmetric, mirror-image processes of each other, a configuration capable of transmitting a radio wave of a certain frequency is also capable of receiving the radio wave having the same frequency. A configuration capable of transmitting and receiving the radio wave having the first frequency includes a transmission-only configuration and a reception-only configuration of the radio wave having such frequency. The same applies to the second frequency.

The antenna device 1 described above is connected with a radio, e.g., a communication device, a transceiver, which is not illustrated, via a coaxial cable. A signal received by the antenna device 1 is serially, e.g., one by one, output to the radio. The antenna device 1 converts an electric signal input from the radio into a radio wave, and transmits/radiates the radio wave through the air. The radio utilizes a signal received by the antenna device 1, and supplies a high-frequency electric power based on the signal to be transmitted.

The following description assumes that the antenna device 1 and the radio are connected by the coaxial cable, but such connection may also be made by using other communication cable. Further, the connection between the antenna device 1 and the radio may include not only the coaxial cable but also other circuits such as a matching circuit, a filter circuit, or the like.

<Configuration of the Antenna Device 1>

Figure 1:
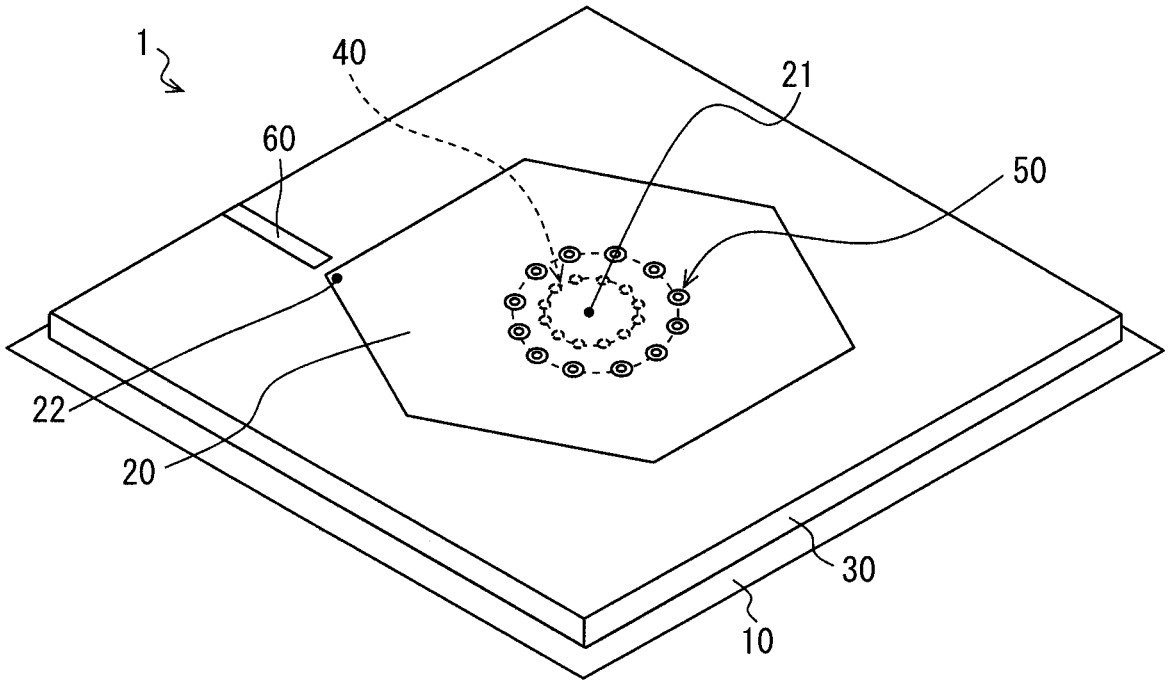
FIG. 1 is a perspective view of an antenna device.
Figure 2:
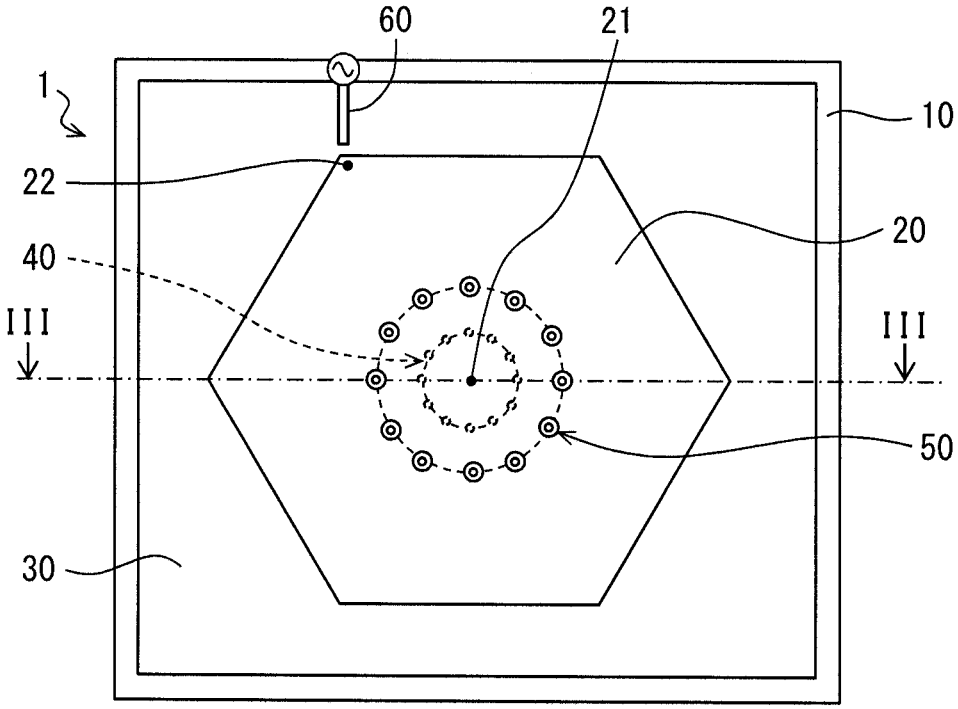
FIG. 2 is a top view of the antenna device.
Figure 3:
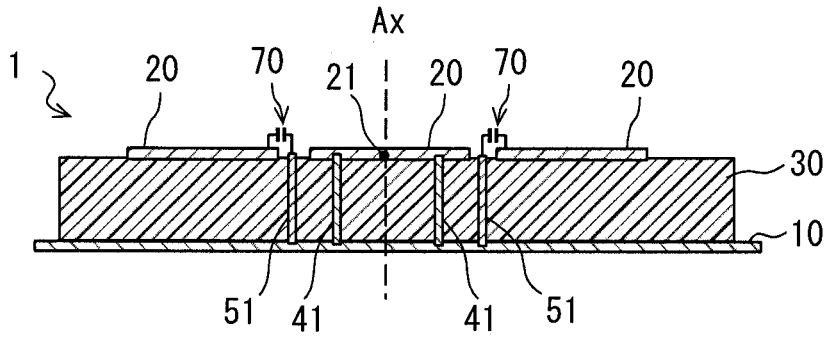
FIG. 3 is a cross-sectional view of the antenna device along a III-III line in FIG. 2.

Hereafter, a configuration of the antenna device 1 is described in more detail. FIG. 1 is a perspective view of an example configuration of the antenna device 1 of the present embodiment. A top view of the antenna device 1 is shown in FIG. 2. FIG. 3 is a cross-sectional view of the antenna device 1 along a III-III line in FIG. 2.

The antenna device 1 is provided with a ground plate 10, a supporter 30, a patch section 20, a first short circuit section 40, a second short circuit section 50, and a feeder line 60, as shown in FIGS. 1-3. As an example, for ease of understanding the drawings, the patch section 20 is assumed to be disposed on a top side of the antenna device 1 relative to the ground plate 10.

The ground plate 10 is a plate-like conductive member made from a conductor, such as copper. That is, the ground plate 10 may be formed as a pattern on a surface of a resin board, such as a printed circuit board. The ground plate 10 is electrically connected with an outer conductor of a coaxial cable, and provides a ground/reference potential for the antenna device 1. The ground plate 10 may have a size at least equal to the patch section 20.

The planar or "2-D" shape of the ground plate 10 as seen from a top side of the antenna device 1, for example, with reference to FIGS. 1 and 2, may be arbitrarily designed. For example, as shown in FIGS. 1 and 2, the planar shape of the ground plate 10 is a rectangular shape. However, the planar shape of the ground plate 10 may also be a polygonal shape such as a hexagon, a circular shape, or a combination of polygonal and circular shapes.

The patch section 20 is a plate-like member made from a conductor, such as copper. The patch section 20 is formed in a regular hexagon shape. The patch section 20 is arranged parallel to the ground plate 10 and separated via the supporter 30, described later in greater detail. The patch section 20 may be made as a thin foil or the like. That is, the patch section 20 may be formed as a conductor pattern on the surface of the resin board, such as a circuit pattern on a printed circuit board. Further, "parallel" in this context does not necessarily mean perfectly parallel, but rather substantially parallel and may allow for a few degrees of skew, for example, up to ten degrees. In other words, parallel in this context means not completely parallel, but substantially parallel to each other.

The patch section 20 and the ground plate 10 are opposingly disposed to face each other to generate a capacitance. The electrostatic capacitance may be based on the area size of the patch section 20 and the distance between the patch section 20 and the ground plate 10. The area size of the patch section 20 may be suitably designed according to a product size of the antenna device 1. The patch section 20 having a right hexagon shape is an example, and the planar shape of the patch section 20 may have other shapes, such as a round/circular shape, a right octagon shape, a square shape, an equilateral triangle shape, and the like. An edge of the patch section 20 may have a meandering shape (e.g., curved/bent) in part or as a whole. The patch section 20 may have a notch on the edge, and/or may have a rounded corner of the edge. The edge of the patch section 20 may also be referred to as an "edge part."

The supporter 30 is a member for supporting the position and posture of the patch section 20 relative to the ground plate 10. The supporter 30 may be a plate/board-like member having a predetermined height and made from an electrical insulation material such as resin. The ground plate 10 and the patch section 20 are disposed facing each other and spaced apart by a predetermined distance by using the supporter 30. The height or thickness, of the supporter 30 may be arbitrarily designed. For ease of understanding the drawings, the supporter 30 may have one surface in contact with the patch section 20 designated as a top face, and may have another surface in contact with the ground plate 10 designated as a bottom face.

The supporter 30 may have other shapes other than the plate/board shape as long as such other shapes are capable of providing the above-described supporting role. The supporter 30 may be provided as a plurality of pillars to separate the ground plate 10 and the patch section 20 at a predetermined distance from one another and in the above-described opposing arrangement. The supporter 30 in the present embodiment, provided as a resin infill disposed in between the ground plate 10 and the patch section 20, may be changed to other forms, such as a void space or a vacuum space with some support structure, or a dielectric body infill having a certain dielectric constant. Further, the supporter 30 may be a combination of the above-described resin infill and vacuum space. When the antenna device 1 is formed by using a printed circuit board, conductor layers in the printed circuit board may respectively be used as the ground plate 10 and the patch section 20, and the resin layer separating the conductor layers may be used as the supporter 30.

The first short circuit section 40 is configured to electrically connect the patch section 20 and the ground plate 10. The first short circuit section 40 is provided with a plurality of first conductive elements 41 that electrically connect the patch section 20 and the ground plate 10. Each of the plurality of first conductive elements 41 is a cylindrically shaped (i.e., pillar-shaped) conductive member having a small diameter, where the ratio of the element diameter to height is very small, which makes the conductive element 41 look like a pin. As such, a conductive pin may serve as the first conductive element 41 and may be referred to as having a pin shape. One end of the first conductive element 41 is connected with the ground plate 10 and the other end is connected with the patch section 20. When the antenna device 1 is formed by using a printed circuit board, a "via" or via hole of the printed circuit board may be used as the first conductive element 41. The first conductive element 41 may have other shapes other than the pillar shape, e.g., may have a rectangular/square pillar shape. The cross section of the first conductive element 41 may also have a semicircular or fan-like shape.

Figure 4:
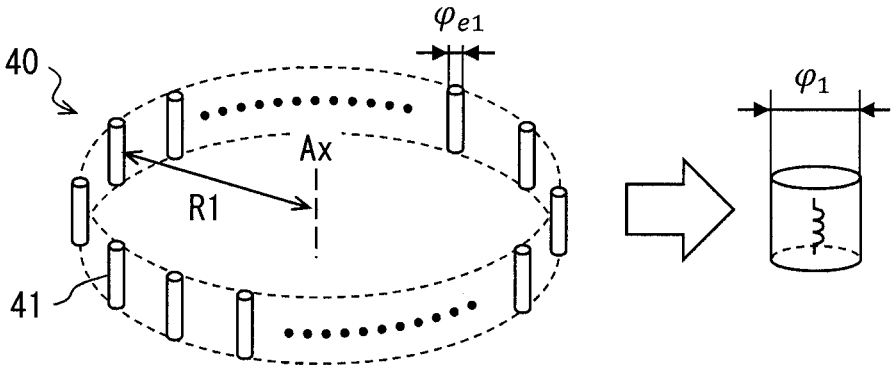
FIG. 4 illustrates a configuration and operation of a first short circuit section of the antenna device.

The plurality of first conductive elements 41 are arranged at equal intervals on the circumference of a circle which centers on the center of the patch section 20 with a preset radius of first distance R1, as shown in FIG. 4 and in other drawings. The center of the patch section 20 is shown as a patch center point 21. That is, the plurality of first conductive elements 41 are equidistantly positioned on a circle with a first radius R1 centered on the patch center point 21. The patch center point 21 corresponds to the center of gravity of the patch section 20. In particular, the patch center point 21 in the present embodiment is positioned at an equal distance from each vertex of a right hexagon. The center of the circle on which the plurality of first conductive elements 41 are arranged does not have to be strictly in agreement with the patch center point 21, that is, the center of gravity of the patch section 20. That is, as long as a directivity bias is contained within a certain tolerance range, the center of the circle of the plural first conductive elements 41 may be dislocated from the patch center point 21.

Further, the distance between two adjacent first conductive elements 41 does not have to be the same for the plurality of first conductive elements. In other words, the plurality of first conductive elements may be unevenly spaced from each other. That is, as long as a directivity bias is contained within a certain tolerance range, the first conductive elements 41 may be unevenly spaced apart from one another or arranged. That is, "equidistant positioning" of the first conductive elements 41 includes "substantially equidistant positioning" of the first conductive elements 41. In other words, the plurality of first conductive elements 41 may be positioned in a well-balanced manner as a whole on the circle of radius R1, even if they are not equidistantly spaced apart from each other.

The circle of the first conductive elements 41 with the radius R1 may also be designated as an "inner circle" for convenience. The inner circle corresponds to the circle of radius R1 centered on the patch center point 21 in the present embodiment. A substantially orthogonal line passing through the patch center point 21 on the patch section 20 and the ground plate 10 may be designated as an antenna center axis Ax. The antenna center axis Ax also orthogonally intersects a plane designated as an "antenna level plane." The antenna level plane corresponds to a plane/flat surface that is parallel to both the patch section 20 and the ground plate 10.

The plurality of first conductive elements 41 are arranged in a standing position, that is, extending longitudinally from the ground plate 10 and aligned in parallel with the antenna center axis Ax. The number (e.g., quantity) of first conductive elements 41 may be designated as "M," e.g., a first element number M, and the number of first conductive elements 41 in the first short circuit section 40 may be arbitrarily set according to the design of the antenna device 1. The first element number M corresponds to the number of the first conductive elements 41 forming the first short circuit section 40. Here, as an example, the first element number M is set as twelve. In another example, the first element number M may be one, which means that one via having a diameter of ϕe1 that corresponds to the radius R1 is provided as the first conductive element 41. The parallel resonance is producible even in such configuration.

The diameter ϕe1 of each of the first conductive elements 41 may be designed arbitrarily. Each of the first conductive elements 41 provides an inductance according to the length in the height direction and the diameter ϕe1. The value of the inductance provided by the first conductive element 41 decreases, as the diameter ϕe1 increases. An inductance of each of the first conductive elements 41 is designated as Le1.

The combination of the plurality of first conductive elements 41 arranged on an inner circle may be represented as one pillar-shape conductive member that has a diameter ϕ1 corresponding to the first distance R1, as shown in FIG. 4. That is, the first short circuit section 40 may be considered as one pillar-shaped conductor that has the center axis of the conductor aligned with the antenna center axis Ax, and that connects the center region of the patch section 20 and the ground plate 10. For convenience, an inductance L1 provided by the first short circuit section 40 serving/acting as a singular pillar-shaped conductor may be designated as a first equivalent inductance L1.

As a result of study and testing of the influence of the first distance (i.e., radius) R1, the first element number M, and the diameter ϕe1 of the first conductive element 41 on the first equivalent inductance L1, the first equivalent inductance L1 may primarily be determined by the first distance R1. That is, a dominant element that determines the first equivalent inductance L1 is the first distance R1. The first short circuit section 40 behaves as a pillar-shaped conductor having a larger diameter ϕ1, as the first distance R1 increases. That is, the first equivalent inductance L1 decreases as the first distance R1 increases.

The first distance R1 that functions as a radius of the inner circle may be set to a value that controls the first equivalent inductance L1 for causing the parallel resonance based on the capacitance and at the first frequency f1 provided by the patch section 20. An adjustment of the first equivalent inductance L1 may be realized by adjusting the first distance R1 The first element number M and/or the diameter of the first conductive element 41 may also be used as parameters to adjust the first equivalent inductance L1.

The second short circuit section 50 is configured to electrically connect the patch section 20 and the ground plate 10. The second short circuit section 50 is provided with a plurality of second conductive elements 51, each of which is a pillar-shaped conductor, just like the first conductive elements 41 in the first short circuit section 40. The second conductive element 51 may also be realized using a conductive pin. When the antenna device 1 is realized using a printed circuit board, the vias of the printed circuit board may be used as the second conductive elements 51.

Figure 5:
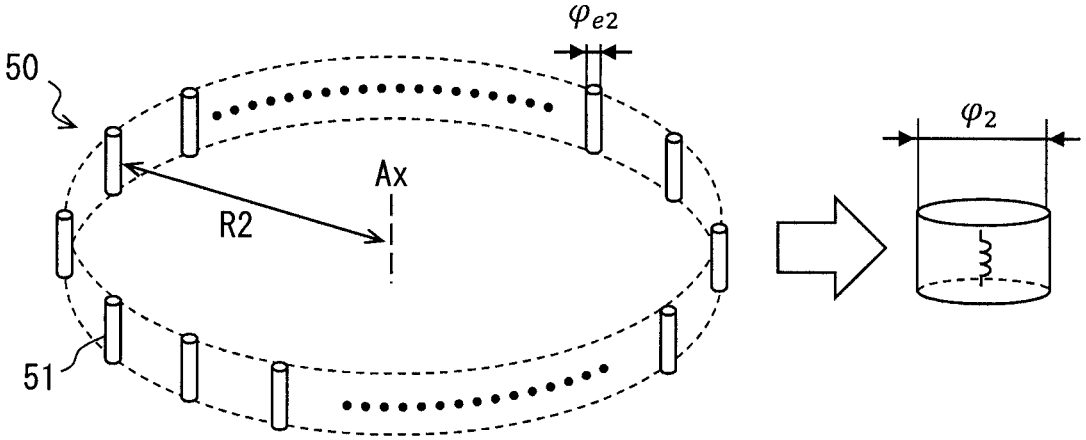
FIG. 5 illustrates a configuration and operation of a second short circuit section of the antenna device.

The plurality of second conductive elements 51 are arranged at equal intervals/distances on the circumference of a circle that is centered on the patch center point 21 with a second preset distance R2, as shown in FIG. 5 and other drawings. That is, the plurality of second conductive elements 51 are equidistantly positioned on a circle of radius R2 centered on the patch center point 21. The circle of radius R2 centered on the patch center point 21 may also be designated as the outer circle for convenience. The intervals or rather the distances between the second conductive elements 51 do not have to be the strictly same distance, just like the arrangement of the first conductive elements 41. In other words, the plurality of second conductive elements 51 may be positioned in a well-balanced manner as a whole on the circle of radius R2. Although it may be preferable that both of the outer circle and the inner circle are a perfect circle, the outer circle and/or the inner circle may be an oval, as long as a directivity bias is contained within a certain tolerance range. In the following paragraphs, a circle may also refer to an oval.

The plurality of second conductive elements 51 are arranged in a standing position, e.g., respectively extending longitudinally from the ground plate 10, or in other words, aligned respectively parallel to the antenna center axis Ax. The number (e.g., quantity) of the second conductive elements 51 may be designated as "N" and referred to as "a second element number N." The second element number N in the second short circuit section 50 may be arbitrarily set according to the design of the antenna device 1. The second element number N may be set, for example, as twelve, that is, the same number as the first conductive elements. However, in other examples, the second element number N may be smaller than the first element number M. For example, the second element number N may be six, or ten. The second element number N may also be two, in which case the parallel resonance may still be producible according to a later-described operation principle. However, when the second element number N is equal to two, a magnetic field concentrates on and around the second conductive elements 51, and a radiation pattern looks like an oval. Therefore, in terms of making the radiation pattern non-directional, the second element number N is preferably three or more. On the other hand, when a directivity bias is tolerable, the second element number N may be two. Further, the second element numbers N (i.e., the quantity of second conductive elements) may be greater than the first element number M. For example, the second element number N may be fourteen or eighteen.

The diameter ϕe2 of each of the second conductive elements 51 may also be arbitrarily designed. Each of the second conductive elements 51 provides an inductance according to the length of the second conductive element 51 in the height direction (e.g., the height of the second conductive element 51) and the diameter ϕe2. The inductance provided by each of the second conductive elements 51 decreases as the diameter ϕe2 increases. For convenience, an inductance provided by each of the second conductive elements 51 is designated as ϕe2.

The plurality of second conductive elements 51 arranged on the outer circle serve as one pillar-shaped conductor having a diameter ϕ2 that corresponds to the second distance R2, as shown in FIG. 5. That is, the second short circuit section 50 may be considered as one pillar-shaped conductor that has the center axis of the conductor aligned with the antenna center axis Ax. From a top view, the second short circuit section 50 is arranged in the center region of the patch section 20.

For convenience, the inductance L2 provided by the second short circuit section 50 serving as one pillar-shaped conductor is designated as a second equivalent inductance L2. The second equivalent inductance L2 is also determined mainly according to the second distance R2. That is, the second short circuit section 50 behaves as a pillar-shaped conductor with a large diameter ϕ2, as the second distance R2 increases. That is, the longer the second distance R2 is, the smaller the value of the second equivalent inductance L2.

The second distance R2 that functions as a radius of the outer circle is set as a value that is at least larger than the first distance R1. Generally, the inductance of a pin-shaped conductive element decreases as the radius of the circle on which the conductive element is arranged increases. That is, the second equivalent inductance L2 takes a value smaller than the first equivalent inductance L1, because the second distance R2 is greater than the first distance R1. As such, a relationship of L1>L2 is observed.

The second distance R2, which serves as a radius of the outer circle, is set to a value that controls (i) the capacitance provided by the patch section 20 and (ii) the second equivalent inductance L2 to cause a parallel resonance at the second frequency f2, described later in greater detail. An adjustment of the second equivalent inductance L2 may be realized by adjusting the second distance R2. The second element number N and/or the diameter of the second conductive element 51 may be additionally used as adjustment parameters for the second equivalent inductance L2.

Figure 6:
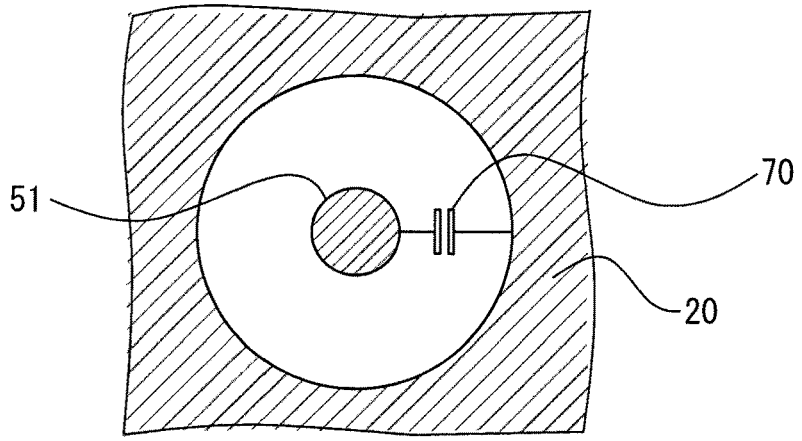
FIG. 6 illustrates a configuration for a connection between a second conductive element and a patch section.

While one end of the second conductive element 51 is connected directly with the ground plate 10, the other end of the element 51 is connected with the patch section 20 via a capacitor 70, as shown in FIG. 6. That is, the capacitor 70 is interposed at a position between the second conductive element 51 and the patch section 20.

A value Cf of the capacitance of the capacitor 70 may be arbitrarily designed according to the first frequency f1, the second frequency f2, and the inductance Le1 of the first conductive element 41. More specifically, it may be designed in the following manner. First, the capacitor 70 is in series connection to the second conductive element 51. Therefore, the capacitor 70, in combination with the inductance Le2 that is provided by the second conductive element 51, forms an LC series resonance circuit at a position between the ground plate 10 and the patch section 20. A resonant frequency fc of the LC resonance circuit is given as $\frac{1}{2\pi}\sqrt{(Le2 \times Cf)}$.

A capacitance Cf of the capacitor 70 is set to a value that makes the resonant frequency fc higher than the first frequency f1. More specifically, the capacitance Cf of the capacitor 70 is set to a value which satisfies the following equation 1.

$$C_f < \frac{1}{4\pi^2 f_1^2 L_{e2}} \quad \text{Equation 1}$$

According to such a setup, the LC series resonance circuit formed by the second conductive element 51 and the capacitor 70 operates as a capacitive reactance at the first frequency f1. This is because the first frequency f1 becomes lower than the resonant frequency fc when the capacitance Cf of the capacitor 70 satisfies equation 1. As shown in the above-given equation 1, the inductance value Le2 of the second conductive element 51 may be used as a variable for setting/controlling the resonant frequency fc to be higher than the first frequency f1. Therefore, both of the inductance Le2 of the second conductive element 51 and the capacitance Cf of the capacitor 70 may be adjusted such that f1<fc.

The capacitor 70 may be provided as a chip capacitor, an embedded capacitor buried inside a substrate, or a plate surface pattern having a predetermined gap. The position of the capacitor 70 may be arbitrarily designed. For example, the capacitor 70 may be arranged at a position between the second conductive element 51 and the ground plate 10, or may be inserted in the middle of the second conductive element 51. When realizing the antenna device 1 by using a substrate, the insert position of the capacitor 70 may be any layer, such as an upper layer (e.g., a surface layer) or an inner layer (e.g., non-surface layer).

FIG. 6 illustrates a top view and uses hatching to clearly show (i) the positional relationship of the components and (ii) material of the components. Further, in FIGS. 1-3, the capacitor 70 is omitted from the drawing for simplification.

The feeder line 60 is a microstrip disposed, for example, on a top surface of the supporter 30, and used to supply an electric power to the patch section 20. One end of the feeder line 60 is electrically connected to the inner conductor of the coaxial cable, and the other end is configured to make an inductive coupling with an edge of the patch section 20. The electric current input to the feeder line 60 via the coaxial cable propagates to the patch section 20, and excites the patch section 20. A point on an edge of the patch section 20 nearest to the feeder line 60 functions as a feeding point 22.

An inductive coupling power feed system using the microstrip is adopted as a power feed system to the patch section 20 in the present embodiment. However, the power feed system may not be limited such system. In the modifications, a direct connection power feed system in which the feeder line 60 is directly connected with the patch section 20 may also be adopted. The direct connection feed system may be realized by using a conductive pin and a via in the substrate. Further, the feeding point 22 may be located at a position between an edge of the patch section 20 and the outer circle.

The antenna device 1 described above may be used in a movable body, such as a vehicle, for example. When the antenna device 1 is used in a vehicle, the position of the antenna device 1 may be arranged so that (i) the ground plate 10 is disposed substantially parallel with the road surface and (ii) a "normal" line extends orthogonally from the ground plate 10 to the patch section 20 and points to a zenith.

<Operation Principle of the Antenna Device 1>

Next, the operation of the antenna device 1 is described with reference to FIG. 7 and other drawings. The antenna device 1 operates in two operation modes. In the first mode of the two operation modes, the antenna device 1 uses the first short circuit section 40 as the main path for electric current. In the second mode of the two operation modes, the antenna device 1 uses the second short circuit section 50 as the main path for electric current. The first operation mode using the first short circuit section 40 as the main path for electric current is at the first frequency f1, and the second operation mode using the second short circuit section 50 as the main path for electric current is at the second frequency f2, both of which are described as follows. The electric current path in the first operating mode may be referred to as a first electric current path and the electric current path in the second operating mode may be referred to as a second electric current path.

The operation principle of the antenna device 1 at the first frequency f1 is described first. The operation of the antenna device 1 when transmitting a radio wave and when receiving a radio wave are "symmetric," or mirror processes to one another. As such, the following description focuses only on the operation when transmitting a radio wave at the first frequency f1 and at the second frequency f2, and the operation of receiving a radio wave is omitted from the following description.

Figure 7:
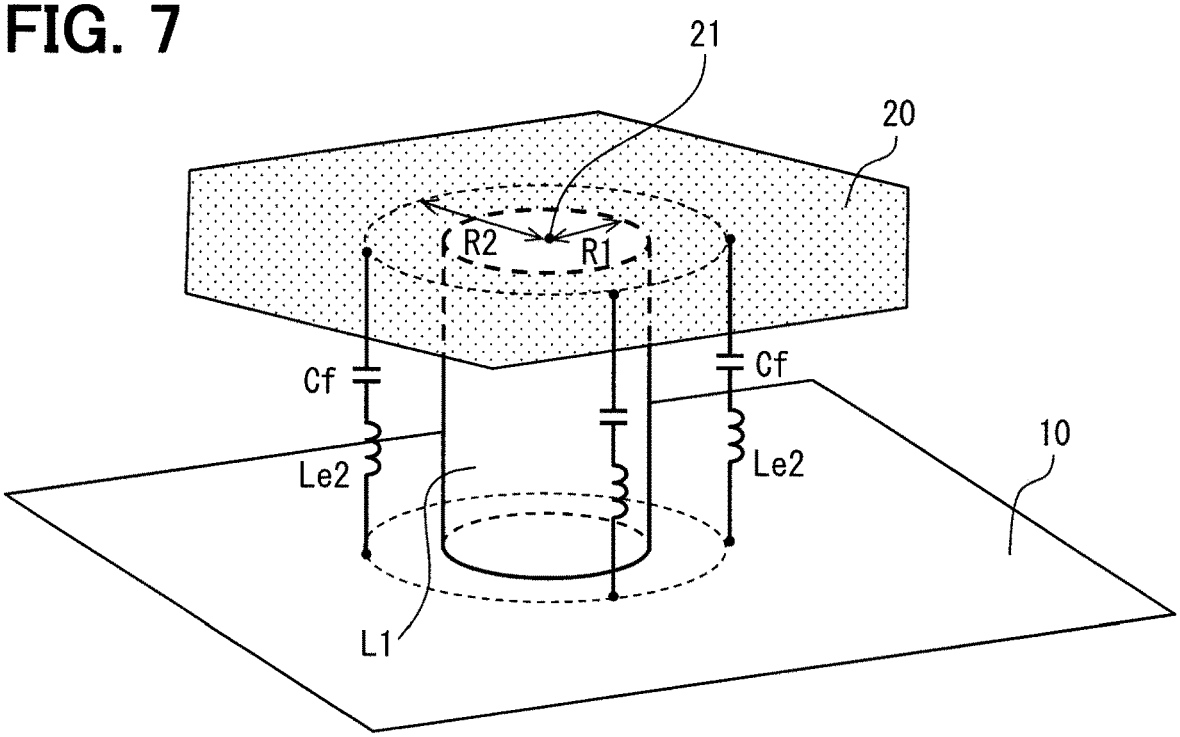
FIG. 7 illustrates the antenna device using the first short circuit section as a main path of electric current.

FIG. 7 is an illustration of the antenna device 1 for a signal having the first frequency in terms of how the device 1 electrically configured to function. In FIG. 7, the distance between the ground plate 10 and the patch section 20 is exaggerated and not true to the actual dimensions. In FIG. 7, the first short circuit section 40 is drawn as a pillar-shape conductor of radius R1. For simplicity and ease of understanding, the second conductive element 51 and relevant part are shown as only three sets of components, when in reality, the second conductive element 51 may be any number or N sets of components. That is, in FIG. 7, the configuration involving the second conductive element 51 is illustrated as a series connection of a second equivalent inductance Le2 (i.e., of the element 51) and a capacitance Cf (i.e., of the capacitor 70).

At the first frequency, the induced conduction current flows through the first short circuit section 40 using the first short circuit section 40 as the main path of electric current. In such a case, the plurality of first conductive elements 41 arranged on the circle of radius R1 operate or appear as one cylindrical, pillar-shaped conductor of radius R1 as described above. The induced conduction current flows mainly on the outside surface of the pillar-shaped conductor (i.e., on a surface of the conductor). As a result, an electromagnetic field hardly enters the inside of the pillar-shaped conductor.

Therefore, on account of the electromagnetic field on the outside of the pillar-shaped conductor, the area of the patch section 20 outside of the circle with radius R1 contributes to the formation of the capacitance in the space between the above-described outside area and the ground plate 10. That is, the outside area of the circle with radius R1 of the patch section 20 forms a capacitance Cp1 that is determined by the size of the outside area and the distance from the ground plate 10. The dot-pattern hatching in FIG. 7 shows the outside area of the circle with radius R1 of the patch section 20.

Figure 8:
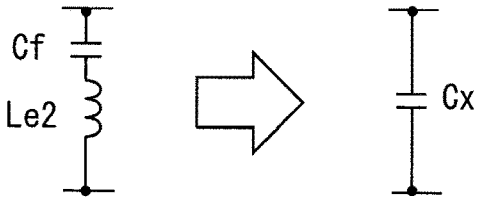
FIG. 8 is a schematic diagram of an equivalent circuit of an LC series resonant circuit made up from the second conductive element and a capacitor.

The LC series resonance circuit that is made up of the second conductive element 51 and the capacitor 70 arranged on the circle with radius R2 is configured to have the resonant frequency fc higher than the first frequency f1. Therefore, the LC series resonance circuit consisting of the second conductive element 51 and the capacitor 70 operates as a capacitor having a capacitance Cx, as shown in FIG. 8.

Figure 9:
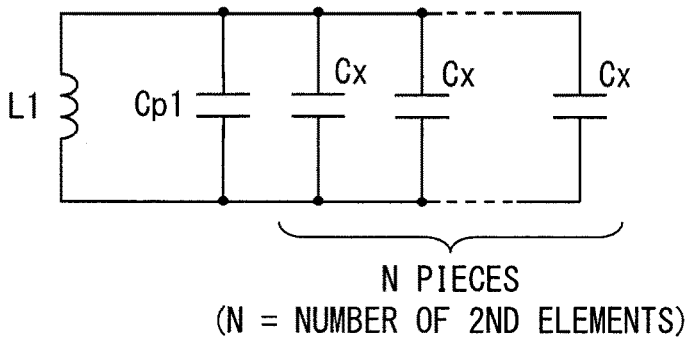
FIG. 9 is a schematic diagram of an equivalent circuit of the antenna device for a signal with a first frequency.

In sum, in the above-described configuration, at the first frequency f1, the antenna device 1 behaves as the configuration shown in FIG. 9 having the inductance L1 (i.e., the first equivalent inductance L1) provided by the pillar-shaped conductor of radius R1 together with a parallel connection of (i) the capacitance Cp1 formed by the outside area of the circle with radius R1 on the patch section 20 and the ground plate 10, and (ii) the capacitance Cx provided by the second conductive element 51. Note that the capacitance Cx is provided by the second element number N as a parallel connection to the first equivalent inductance L1 and to the capacitance Cp1. Therefore, the total capacitance provided as a parallel connection to the first equivalent inductance L1 is calculated as Cp1+N×Cx.

As described above, in the antenna device 1, the capacitance Cp1+N×Cx is provided as a parallel connection to the first equivalent inductance L1 of the first short circuit section 40. As such, the antenna device 1 causes a parallel resonance at a frequency fix that is determined by the following equation 2.

$$f_{1x} = \frac{1}{2\pi\sqrt{L_1(C_{p1} + NC_x)}} \quad \text{Equation 2}$$

The resonant frequency fix is determined based on the size of the ground plate 10 and the patch section 20, the distance between the ground plate 10 and the patch section 20, the first distance R1, the diameter of the second conductive element 51, and the capacitance Cf of the capacitor 70. Therefore, is by adjusting those parameters, the resonant frequency f1*x* can be matched with the first frequency f1. That is, the parallel resonance is caused at the first frequency f1, and the radio wave of the first frequency f1 is transmitted and received.

The feeder line 60 may also have an inductance and a resistance, where the magnitude of the inductance/resistance is determined according to the shape and material of the feeder line 60. However, these factors of the feeder line 60 are negligible in terms of the operation principle of the antenna device 1, and as such, the feeder line 60 is omitted from the equivalent circuit shown in FIG. 9.

Figure 10:
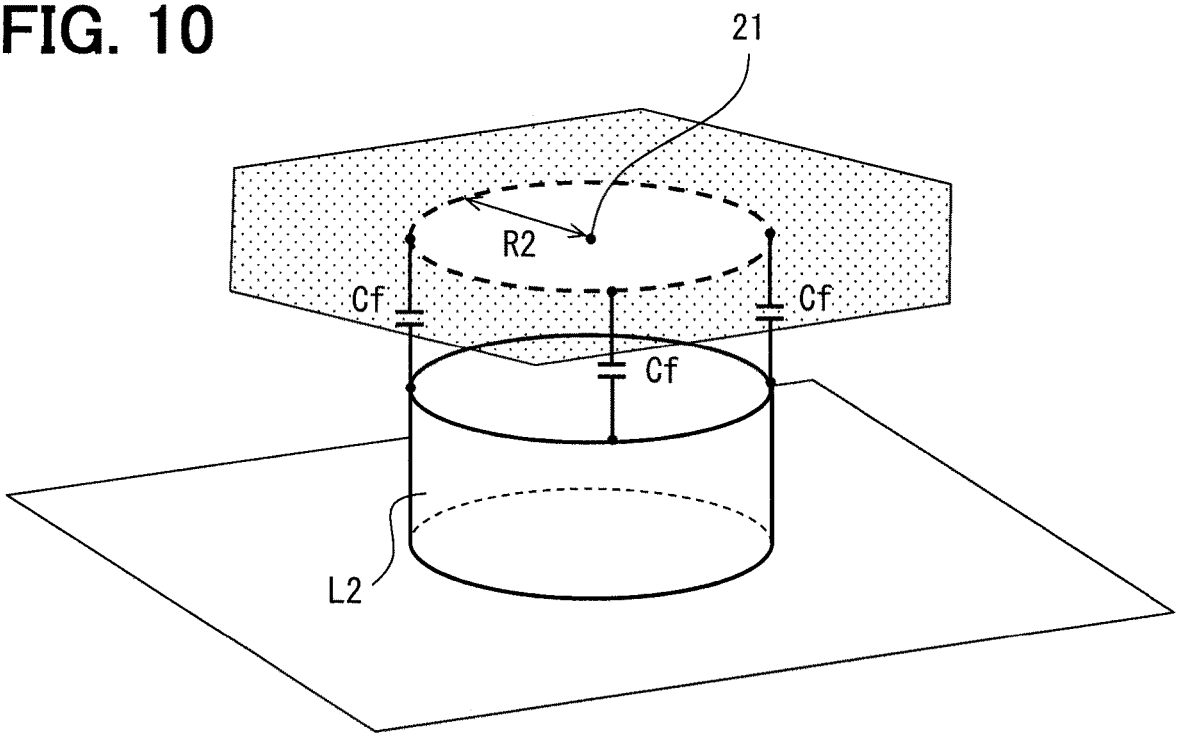
FIG. 10 illustrates the antenna device using the second short circuit section as a main path of electric current.

Next, the operation principle of the antenna device 1 at the second frequency f2 is described. FIG. 10, similar to FIG. 7, illustrates a configuration of the antenna device 1 for a signal having the second frequency in terms of how the device 1 electrically functions. In FIG. 10, just like FIG. 7, the distance between the ground plate 10 and the patch section 20 is "exaggerated" or not true to the actual dimensions. The second short circuit section 50 is shown as a pillar-shaped conductor of radius R2. For simplicity and ease of understanding, there are only three capacitors 70 shown in FIG. 10, but the capacitor 70 may be provided as any quantity or N sets of components in the antenna device 1. That is, an equivalent to the capacitor 70 is an element having a capacitance Cf, as shown in the electrical configuration of FIG. 10.

At the second frequency, the induced conduction current flows through the second short circuit section 50, using the second short circuit section 50 as the main path for electric current. In such a case, the plurality of second conductive elements 51 arranged on the circle with radius R2 operate or appear as one pillar-shaped conductor of radius R2 as described above, and the induced conduction current flows mainly on the outside surface of the pillar-shaped conductor. As a result, an electromagnetic field hardly enters the inside of the pillar-shaped conductor. As such, the first conductive elements 41 arranged on the circle with radius R1 barely contribute to excitation.

Therefore, on account of the electromagnetic field staying on the outside of the pillar-shaped conductor, the area of the patch section 20 outside of the circle with radius R2 contributes to a formation of the capacitance in a space between the above-described outside area and the ground plate 10. That is, the outside area of the circle with radius R2 on the patch section 20 forms a capacitance Cp2 that is determined by the size of the outside area and the distance from the ground plate 10. Since the size of the outside area size contributing to the capacitance formation for the second frequency is smaller than the outside area for the operation at the first frequency f1 the relationship between Cp1 and Cp2 is represented as Cp2<Cp1. The dot-pattern hatching in FIG. 10 shows the outside area of the circle with radius R2 on the patch section 20.

The capacitance Cf provided by each of the plurality of capacitors 70 is provided by a parallel connection of the N pieces of capacitors 70. The capacitance Cf is connected in series to an inductance L2 provided by the second short circuit section 50, that is, a series connection to the second equivalent inductance L2. Since the capacitance Cf is provided by each of the plurality of capacitors 70 arranged in parallel with each other, the total value of the capacitance provided by the plurality of capacitors 70 is equal to Cf×N.

Figure 11:
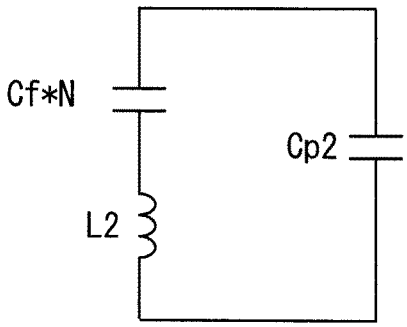
FIG. 11 is a schematic diagram of an equivalent circuit of the antenna device for a signal with a second frequency.

In the above-described configuration, at the second frequency f2, the antenna device 1 behaves as the configuration shown in FIG. 11 having the second equivalent inductance L2 provided by the pillar-shaped conductor of radius R2, the capacitance Cf×N of the capacitors 70, and the capacitance Cp2 formed by the ground plate 10 and the patch section 20. The capacitance Cy of the whole circuit is calculated as a series circuit, that is, a sum of Cp2 and Cf×N. The capacitance Cy=Cp2×N×Cf/(Cp2+N×Cf).

The antenna device 1 resonates at the frequency f2*x* that is determined by the following equation 3, when using the second short circuit section 50 as a main path of electric current.

$$f_{2x} = \frac{1}{2\pi\sqrt{L_2 C_y}} \quad \text{Equation 3}$$

The resonant frequency f2*x* is determined based on the size of the ground plate 10 and the patch section 20, the distance between the ground plate 10 and the patch section 20, the second distance R2, the capacitance Cf of the capacitor 70, the second element number N. Therefore, by adjusting those parameters, the resonant frequency f2*x* can be matched with the second frequency f2. That is, transmission and reception of the radio wave are enabled at the second frequency f2, which is the desired target frequency.

Here, the resonant frequency f2*x* when using the second conductive element 51 as the main path for electric current is a frequency higher than the resonant frequency f1*x* when using the first conductive element 41 as the main path for electric current, based on the relationships Cp1>Cp2 and L1>L2. When the second element number N is relatively small, e.g., three or so, the magnetic field amount distributed in the inside area of the circle of radius R2 increases accordingly, as compared to cases where the second element number N is greater than three. As a result, the concentration of magnetic energy at the second short circuit section 50 increases and the second equivalent inductance L2 increases.

<Directivity of the Antenna Device 1>

The radiation characteristics of the radio wave of the antenna device 1 are described in the following paragraphs. The radiation characteristics of the radio wave having the first frequency f1 are described first. The radiation of the radio wave having the first frequency f1 from the antenna device 1 means that the parallel resonance is caused at the first frequency f1 in the antenna device 1. That is, the first conductive element 41 functions as the main path for electric current.

When the antenna device 1 causes the parallel resonance at the first frequency f1, a resonance current is induced in the patch section 20. The electric current of the first frequency f1 induced in the patch section 20 by the parallel resonance flows along the edge of the patch section 20 to the first short circuit section 40. The electric current of the first frequency f1 propagates to the ground plate 10 mainly via the side surface of the pillar-shaped conductor with radius R1. That is, the electric current concentrates at the center region of the patch section 20 and the amplitude of the current standing wave is maximized on the circle with radius R1, but is equal to zero at the edge of the patch section 20.

Since the first short circuit section 40 that functions as a pillar-shaped conductor is disposed so that its center axis is aligned with the antenna center axis Ax, the amplitude of a voltage standing wave is maximized at the edge of the patch section 20, and is equal to zero on or near the circle with radius R1. The sign of the voltage is the same in any region along the vertical direction. The vertical electric field is also proportional to the distribution of the voltage. Therefore, the vertical electric field generated in between the ground plate 10 and the patch section 20 is distributed symmetrically around the patch center point 21. As seen from the top view, the patch center point 21 is on a rotation axis of the antenna device 1.

The vertical electric field induced in the space between the patch section 20 and the ground plate 10 serves as a vertically-polarized wave at or around the edge of the patch section 20, and spreads into outer space. Thus, the antenna device 1 radiates a vertically-polarized wave in a centrifugal direction, that is, radially from the outer edge of the patch section 20. Note that a centrifugal direction may be perpendicular to the antenna center axis Ax and pointing away from the axis Ax.

The antenna device 1 is configured to be symmetric about the antenna center axis Ax. More specifically, the patch section 20 is formed as a point-symmetric shape on the patch center point 21. Therefore, the antenna device 1 radiates a vertically-polarized wave having the first frequency f1 in a direction with the same gain from the center of the patch section 20 to the edge of the patch section 20.

Figure 12:
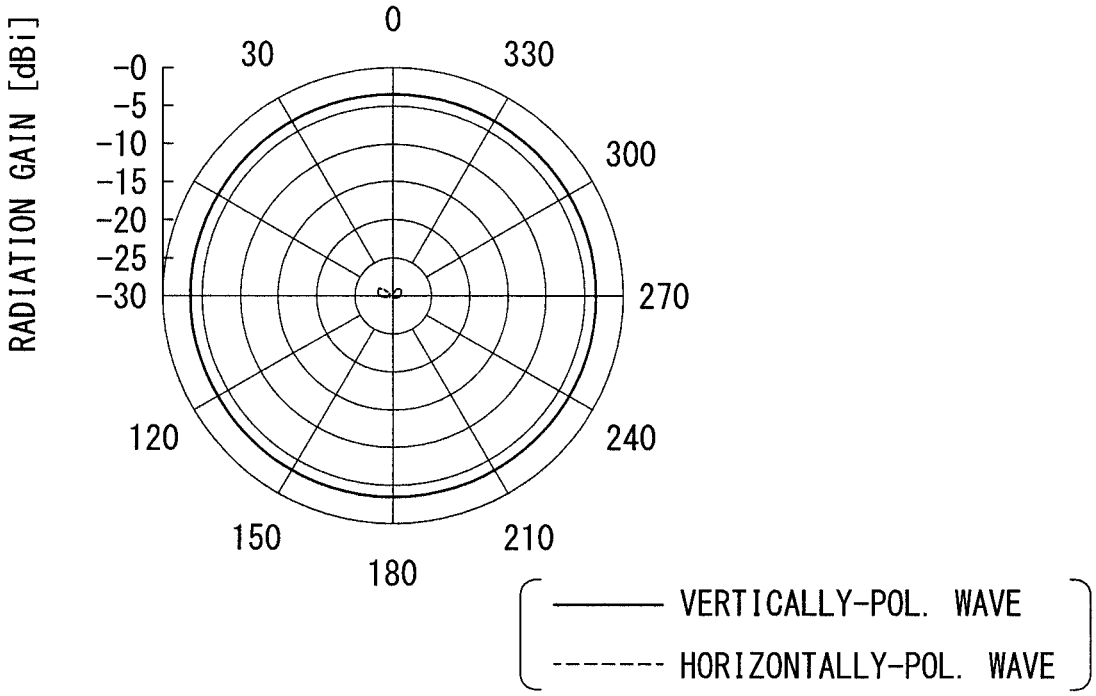
FIG. 12 illustrates a simulation result of radiation characteristics for a radio wave having the first frequency.

FIG. 12 illustrates a simulation result in a level plane of the antenna device 1 (i.e., in an antenna level plane) for the radiation characteristics of the radio wave having the first frequency f1 The solid line in FIG. 12 shows a radiation gain of a vertically-polarized wave, and the dashed line shows a radiation gain of a horizontally-polarized wave, respectively. FIG. 12 illustrates that the radiation characteristics of the vertically-polarized wave of the first frequency f1 from the antenna device 1 show substantially no directivity. Therefore, when the antenna device 1 is disposed on a vehicle with the ground plate 10 substantially parallel to the road surface, the antenna device 1 operates as a horizontally-non-directional antenna.

The above-described principle for the radiation of the radio wave at the first frequency f1 and the directivity also applies, as is, to the radio wave at the second frequency f2. That is, the second short circuit section 50, just like the first short circuit section 40, can be considered as one pillar-shaped conductor arranged in the center region of the patch section 20. Therefore, the electric current at the second frequency f2 that is caused in the patch section 20 by the parallel resonance flows in the direction from the edge of the patch section 20 to the second short circuit section 50. As a result, the amplitude of the voltage standing wave is maximized at the edge of the patch section 20 and is equal to zero at or around the second short circuit section 50. The vertical electric field formed in the space between the ground plate 10 and the patch section 20 proceeds radially from the second short circuit section 50 in a centrifugal direction.

The propagation direction of the vertical electric field is point-symmetric about the antenna center axis Ax, and as such, the antenna device 1 radiates a vertically-polarized wave having the second frequency f2 also in the centrifugal direction, that is, in all directions toward the edge of the patch section 20 from the second short circuit section 50. More specifically, when the antenna device 1 (i.e., an antenna level plane) is disposed parallel to the plane of the road surface, the antenna device 1 functions as a non-directional antenna in the level plane (i.e., in all horizontal directions).

Figure 13:
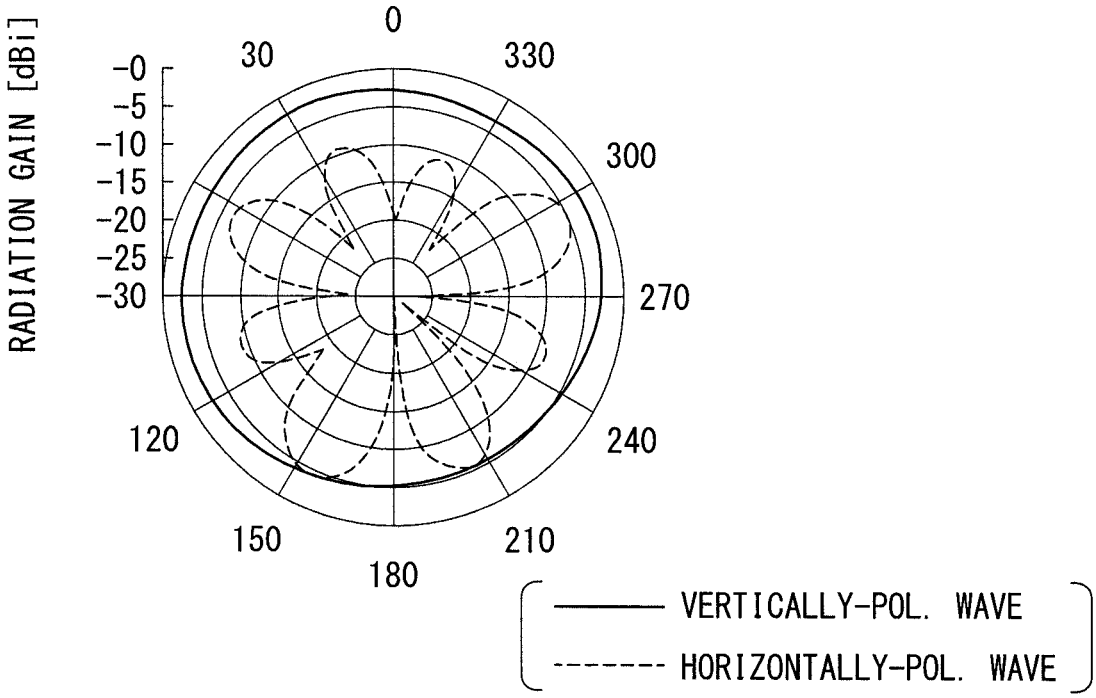
FIG. 13 illustrates a simulation result of radiation characteristics for a radio wave having the second frequency.

FIG. 13 illustrates a simulation result in a level plane of the antenna device 1 (i.e., in an antenna level plane) for the radiation characteristics of the radio wave having the second frequency f2. The solid line in FIG. 13 shows the radiation gain of the vertically-polarized wave, and the dashed line shows the radiation gain of the horizontally-polarized wave, respectively. As shown in FIG. 13, the radiation characteristics of the vertically-polarized wave at the second frequency f2 are substantially non-directional.

<Design Procedure of the Antenna Device 1>

The antenna device 1 described above may be designed, for example, based on the procedure described in the following paragraphs. The procedure shown below is an example and may be arbitrarily modified.

After setting up the size of the ground plate 10 and the patch section 20, the distance between the ground plate 10 and the patch section 20, and the material of the supporter 30, a temporary value of the capacitance Cf of the capacitor 70 and a temporary value of the diameter of the second conductive element 51 are determined, and the capacitance Cx provided by the LC series resonance circuit at the first frequency f1 is identified. By determining the second element number N, a value of an N×Cx component and a value of an N×Cf component can be determined.

Then, the first distance R1 is set by taking the total area size of the patch section 20 into consideration so that the capacitance Cp1 and the first equivalent inductance L1 are obtained as desired target values based on the N×Cx component. As described above, since an electromagnetic field does not enter (i.e., penetrate into) the inside of the pillar-shaped conductor with radius R1 during operation at the first frequency f1, the capacitance Cp1 formed by the patch section 20 is defined by the size of the area between the first short circuit section 40 and the edge of the patch section 20. Further, when the first distance R1 increases, the first equivalent inductance L1 decreases. That is, in other words, when the first distance R1 increases, the first equivalent inductance L1 and the capacitance Cp1 both decrease. Thus, the first distance R1 is set so that the operation frequency f1$x$ matches with the first frequency f1, taking into consideration that the first equivalent inductance L1 and the capacitance Cp1 simultaneously change according to the first distance R1.

The second distance R2 is set by taking into consideration the total area size of the patch section 20, so that the capacitance Cp2 and the second equivalent inductance L2 are obtained as desired target values based on the N×Cf component. At the second frequency, the capacitance Cp2 formed by the patch section 20 is determined, just like the first frequency, by the area size between the second short circuit section 50 and the edge of the patch section 20. When the second distance R2 increases, the second equivalent inductance L2 and the capacitance Cp2 both decrease. Thus, the second distance R2 is set so that the operation frequency f2*x* matches with the second frequency f2, taking into consideration that the second equivalent inductance L2 and the capacitance Cp2 simultaneously change according to the second distance R2. The temporary value of the second element number N and the temporary value of the capacitance Cf of the capacitor 70 may further be adjusted and fine-tuned in the course of determining the first distance R1 and the second distance R2.

<Effects of the Antenna Device 1>

Figure 14:
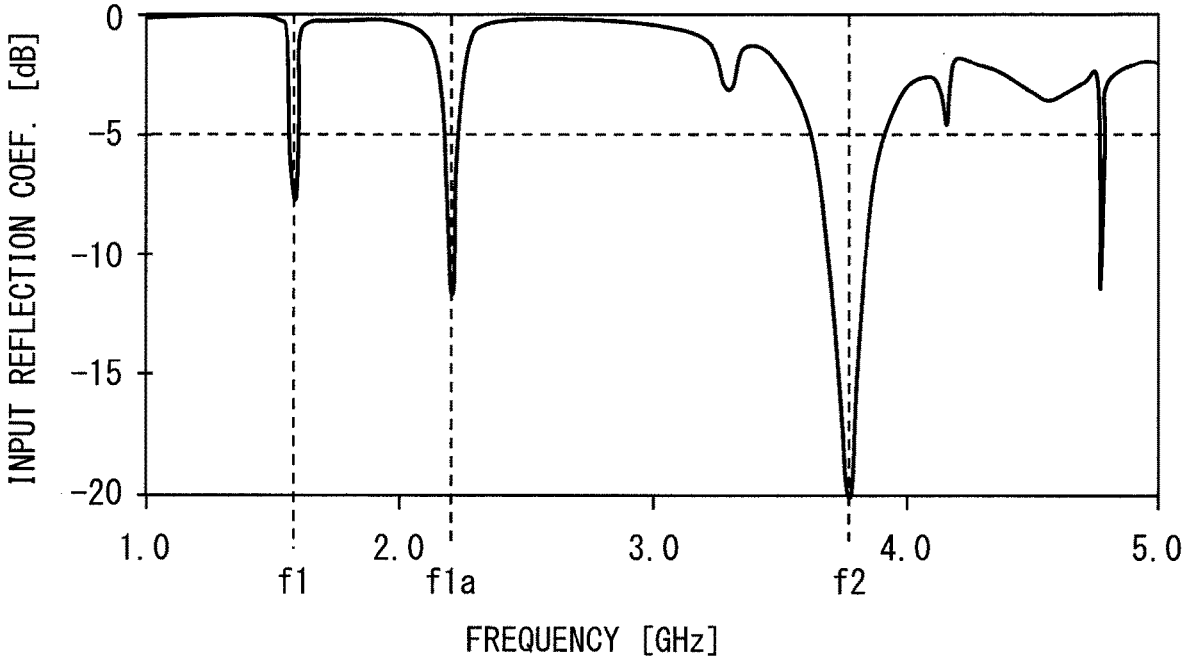
FIG. 14 is a characteristic diagram of a relationship between an input reflection coefficient versus frequency for the antenna device.

According to the configuration described above, the antenna device 1 is capable of radiating the vertically-polarized wave of the first frequency f1 and the vertically-polarized wave of the second frequency f2 by using one patch section 20. Reception of the radio wave at those frequencies is also possible by the above-described configuration. FIG. 14 shows a characteristic diagram of an input reflection coefficient analyzed against the input frequency of the antenna device 1. Note that the input reflection coefficient corresponds to S11 of a so-called S parameter and may also be designated as a forward direction reflection coefficient.

As shown in FIG. 14, based on the configuration of the present embodiment, the input reflection coefficient of the first frequency f1 is −7.5 dB, and the input reflection coefficient of the second frequency f2 is −20 dB. Generally, it is considered that the device is practically operable when the input reflection coefficient is less than −5 dB. That is, according to the configuration of the present embodiment, the antenna device 1 is fully usable as an antenna for transmitting and receiving both of the first frequency f1 and the second frequency f2.

Note that the first frequency f1 is the operation frequency at the time of zero-order resonance when the first short circuit section 40 is used as the main electric current path, and the second frequency f2 is the operation frequency at the time of zero-order resonance when the second short circuit section 50 is used as the main electric current path. The frequency f1 a shown in FIG. 14 at 2.2 GHz is the operation frequency at the time of first-order resonance where the first short circuit section 40 is used as the main electric current path.

As compared to other antennas such as a series resonance antenna device, the height of the antenna device 1 in the present embodiment may be reduced in comparison to the series resonance antenna device. That is, in other words, the antenna device 1 of the present embodiment may be made thinner than the series resonance antenna device. The series resonance antenna device may be, for example, a monopole antenna. More specifically, the antenna device 1 of the present disclosure may be realized as a device about 7% in height relative to the height of a monopole antenna for transmitting and receiving the same first frequency f1. That is, the antenna device 1 of the present embodiment described above can be made thinner than conventional antennas while also operating at two frequencies without needing a larger footprint to accommodate additional elements.

The present disclosure is not limited to the above-described embodiment. That is, various modifications, including the ones described below, may further be included in the technical scope of the present disclosure, as long as the gist of each of the modifications pertains to the technical scope of the present disclosure. Also, the modifications and embodiments may be combined either in part or as a whole, as long as no inconsistency hinders such a combination.

In the following paragraphs, where like elements and features from the above embodiment are described with regard to the modifications, the same reference characters may be used for ease of understanding and a repeat description of the like elements and features may be omitted for brevity.

[First Modification]

In the above-described embodiment, the configuration of the antenna device 1 is described as an arrangement of the second conductive elements 51 disposed on lines extending from the patch center point 21 and through the first conductive elements 41 in a top view of the device 1.

In other words, the first short circuit section 40 and the second short circuit section 50 are so configured that the lines extending radially from the patch center point 21 to each of the first conductive elements 41 further extend to each of the second conductive elements 51 so that the first conductive elements 41 and second conductive elements 51 are disposed on the same line, for example, as shown by the first conductive elements 41 and the second conductive elements 51 on the cross-sectional line in FIG. 2.

Figure 16:
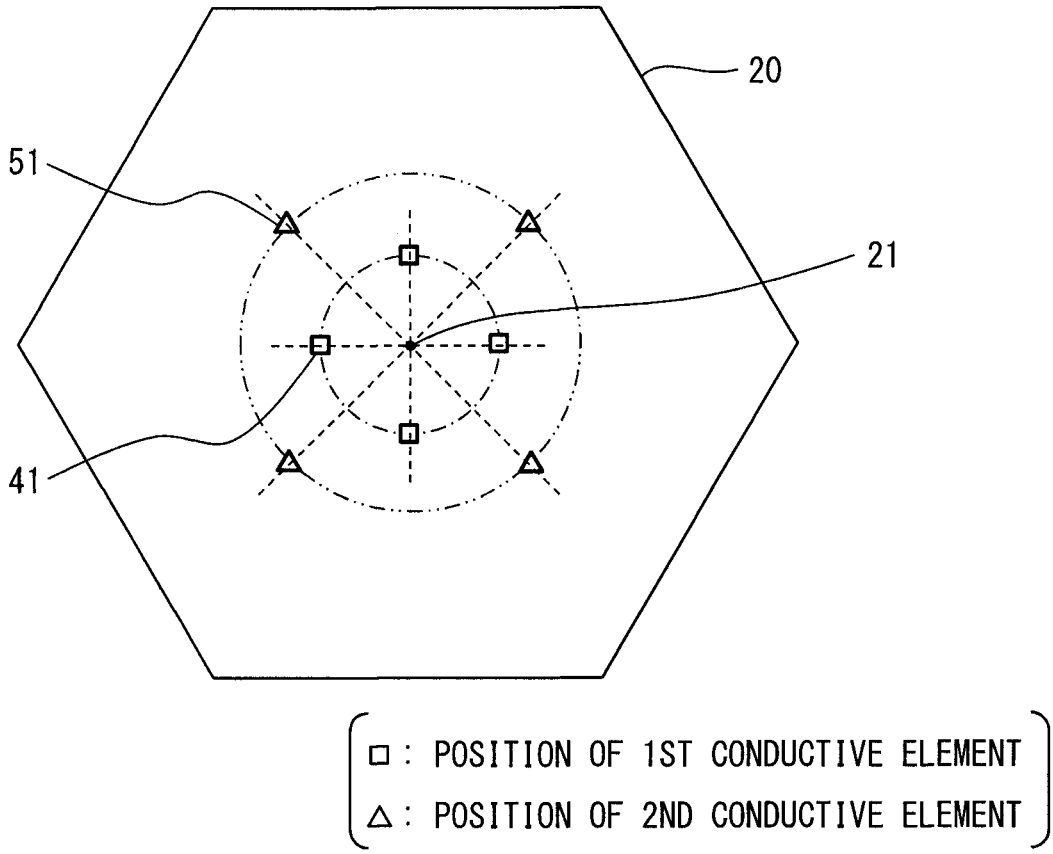
FIG. 16 illustrates a modified arrangement of the first short circuit section and the second short circuit section.

On the other hand, as shown in FIG. 16, the second short circuit section 50 may be configured relative to the first short circuit section 40 so that a line extending radially from the patch center point 21 to the second conductive element 51 does not intersect or pass through the first conductive element 41.

FIG. 16 shows an example configuration where the first element number M and the second element number N are set to the same number. In other words, the quantity of first conductive elements 41 and second conductive elements 51 are the same. In this example, M and N are both four. The lines extending radially from the patch center point 21 to the elements 51 and the lines extending radially from the patch center point 21 to the elements 41 do not overlap with each other.

The squares in FIG. 16 show the positions of the first conductive elements 41 and the triangles show the positions of the second conductive elements 51. The single-dot-single-dash line in FIG. 16 shows the inner circle on which the first conductive elements 41 are positioned. The double-dot-single-dash line shows the outer circle on which the second conductive elements 51 are positioned.

When the same number of first conductive elements 41 and the second conductive elements 51 are provided, e.g., in cases where M and N is an integer of three or more, the line extending from the patch center point 21 to the second conductive element 51 may be angularly offset from the line extending radially from the patch center point 21 to the first conductive element 41 by an angle of 180/N degrees. For example, when there are both four of the first conductive elements 41 and the second element (i.e., N=4), the line extending radially from the patch center point 21 to the second conductive element 51 may be angularly offset 45 degrees relative to the line extending from the patch center point 21 to the first conductive element 41.

Based on this configuration, the spacing between the first conductive elements 41 and the second conductive elements 51 can be increased to limit the electromagnetic interference between the conductive elements 41 and 51. Such configuration provides an increased level of independence between the two operations, that is, the operation at the first frequency f1 and the operation at the second frequency f2.

Although the first element number M and the second element number N are equal in the example of FIG. 16, the first element number M may be different from the second element number N. That is, by devising an arrangement where the lines extending from the patch center point 21 to the first conductive elements 41 of the first short circuit section 40 are offset from the lines extending from the patch center point 21 to the second conductive elements 51 of the second short circuit section 50, the above-described effects may be achieved by providing such an offset between the conductive elements 41 and 51. That is, the electromagnetic effects between the first conductive elements 41 and the second conductive elements 51 may be limited by the above-described arrangement.

[Second Modification]

Figure 15:
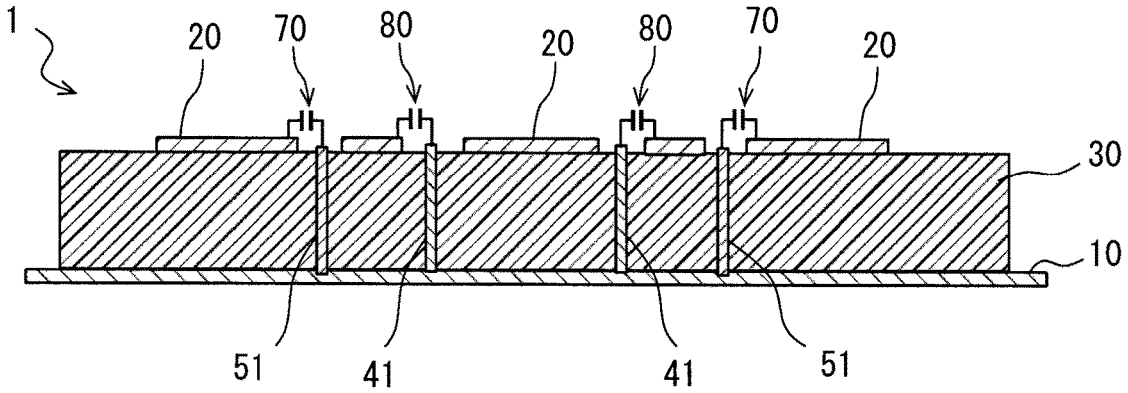
FIG. 15 illustrates a configuration for an electric current path via a first conductive element having a capacitor.

The capacitor 70 is disposed as a capacitive element on the electric current path that passes through the second conductive element 51 in the above-described embodiment. However, as shown in FIG. 15, a capacitor 80 may be disposed on the electric current path that passes through the first conductive element 41. The capacitor 80 may be provided as a chip capacitor, an embedded capacitor that is disposed on an inside of the substrate, or may be a planar gap pattern provided with a preset distance on the substrate.

The position of the capacitors 80 may be arbitrary. For example, the capacitor 80 may be disposed at a position between the first conductive element 41 and the patch section 20, as shown in FIG. 15, or may be disposed at a position between the first conductive element 41 and the ground plate 10. The capacitor 80 may also be inserted in the middle of the first conductive element 41. When realizing the antenna device 1 by using a substrate, the position of the capacitor 80 may be on an upper surface layer, or may be disposed in an inner layer.

According to such configuration, the first frequency f1 may also be adjustable by adjusting the capacitance value of the capacitor 80. In this modification, the capacitor 80 corresponds to a first capacitive element, and the capacitor 70 corresponds to a second capacitive element.

[Third Modification]

Figure 17:
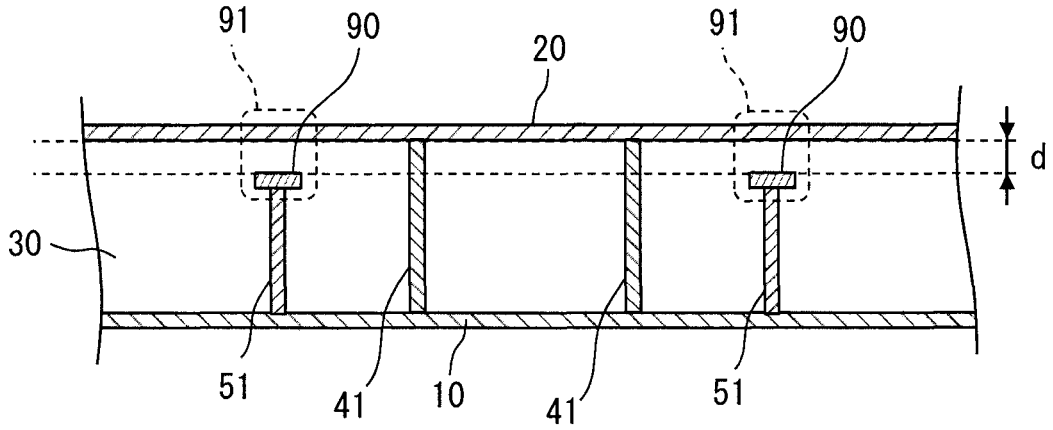
FIG. 17 illustrates a modified configuration of a capacitive element.

In the above-described embodiment and as shown in FIG. 3, the capacitor 70 is disposed on the surface of the patch section 20. However, the capacitor 70 serving as a capacitive element may be implemented differently. For example, as shown in FIG. 17, by disposing a conductor plate 90, i.e., an inner conductor plate 90, with a preset area size on the inside of the supporter 30 so that the inner conductor plate 90 faces the patch section 20, the electric current path at the first frequency f1 and the electric current path at the second frequency f2 may be further separated from one another. A structure 91 that includes the inner conductor plate 90 and a part of the patch section 20 facing the plate 90 may function as a capacitive element (e.g., in place of the capacitor 70. Note that the inside of the supporter 30 means a space between the patch section 20 and the ground plate 10. FIG. 17 shows a sectional view of the proximate position of the second short circuit section 50, as shown by the position of the second conductive elements 51.

A distance d between the inner conductor plate 90 and the patch section 20 as well as the area size of the inner conductor plate 90 may be so configured that the capacitance in between the inner conductor plate 90 and the patch section 20 is equal to the capacitance of the capacitor 70 in the above-described embodiment. In other words, the capacitance may be set to a value that blocks the signal of the first frequency f1 while allowing the signal of the second frequency f2 to pass through. The planar shape of the inner conductor plate 90 may be arbitrarily defined. A chip capacitor may be inserted instead of providing the inner conductor plate 90.

The inner conductor plate 90 is disposed at a position which overlaps with the second conductive element 51 in a top view. The inner conductor plate 90 is provided for each second conductive element 51. The second conductive element 51 is provided to connect the inner conductor plate 90 and the ground plate 10. Note that the inner conductor plate 90 is disposed so that the plate 90 does not electrically contact the first conductive element 41.

Such configuration is operable in the same manner as the above-described embodiment. Note that the configuration described in the third modification may be realized using a substrate of Carbon, Silicon, Germanium, or like material. The inner conductor plate 90 may be implemented by using one conductive layer in a multilayer substrate.

[Fourth Modification]

The antenna device 1 described above is described as a configuration for transmitting and receiving a radio wave having two frequencies, e.g., the first frequency f1 and the second frequency f2. However, the antenna device 1 may be configured to transmitting and receiving a radio wave of three or more frequencies.

Figure 18:
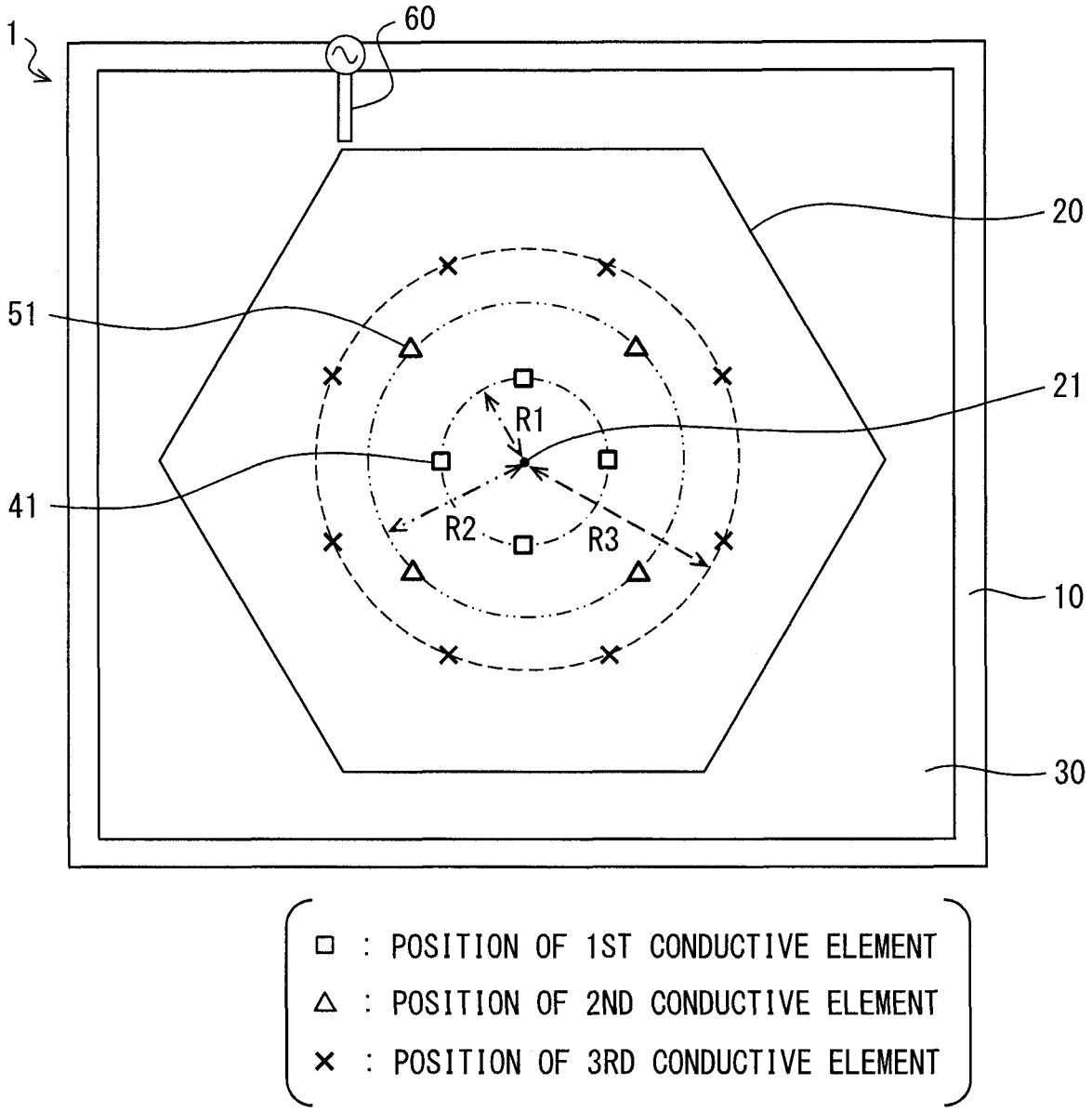
FIG. 18 illustrates a configuration of the antenna device transmitting and receiving the radio wave at three independent frequencies.

For example, as shown in FIG. 18, by having a plurality of third conductive elements arranged on a circle at a distance (e.g., R3) from the patch center point 21 that is greater than the second distance R2, the antenna device 1 may be configured to transmit and receive the radio wave of a third frequency. The "x" in FIG. 18 shows example positions of the third conductive elements.

The third conductive element may be configured in a similar manner as the second conductive element, and is used for connecting the ground plate 10 and the patch section 20. The third conductive element may be connected with the patch section 20 via a capacitor or like capacitance device that provides the capacitance based on the first frequency f1 or the second frequency f2. When not distinguishing the first conductive element 41 and/or the second conductive element 51 from the third conductive element, those elements may be simply referred to as conductive elements.

[Fifth Modification]

As shown in FIG. 19 to FIG. 24, a loop section 100 is a conductor member having a loop shape that may be disposed to encircle the patch section 20. Such configuration is described as the fifth modification in the following paragraphs. For convenience, in the fifth modification and subsequent modifications, the concept of a sub-patch section 23 that may be either a virtual or substantive (i.e., actual) division of the patch section 20 is introduced to describe the arrangement of the first conductive element 41 and/or the second conductive element 51.

Figure 19:
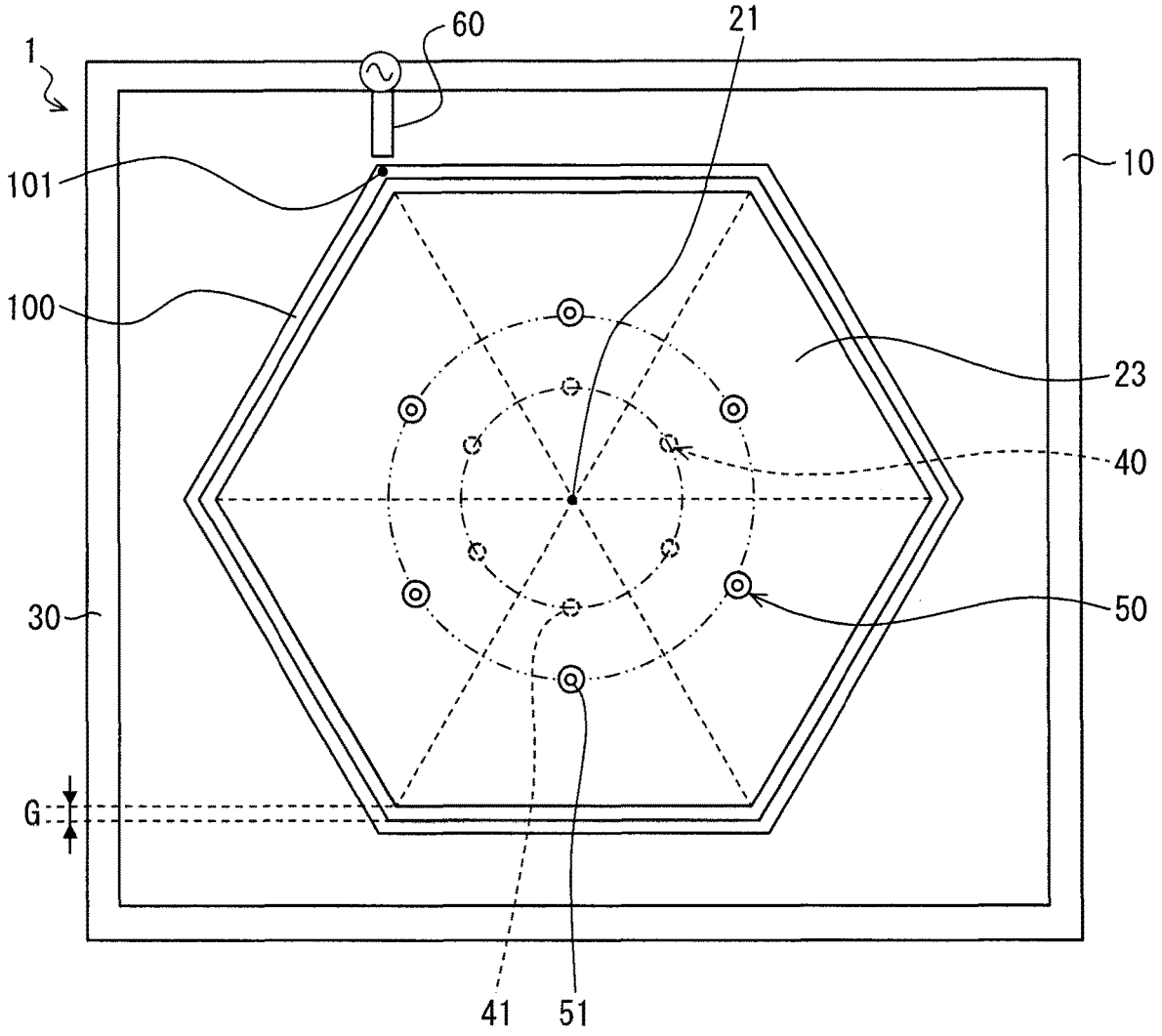
FIG. 19 is a top view of the antenna device in another modification example.

Here, a sub-patch section 23 may be a part or subdivision of the patch section 20 that is divided by the plurality of dashed lines extending from the patch center point 21 to the vertexes on the edge of the patch section 20, for example, as shown in FIG. 19. That is, as shown in FIG. 19, the patch section 20 in a regular hexagon shape is subdivided into six sub-patch sections 23. The dashed line shown on the patch section 20 in FIG. 19 is a border line, or rather a sub-patch border line, of the sub-patch section 23. The sub-patch border lines correspond to the lines that connect the patch center point 21 and vertexes on the edge of the patch section 20. Note that the single-dash-single-dot circle and the double-dot-single-dash circle shown on the patch section 20 respectively represent the inner circle at a first distance R1 from the patch center point 21, and the outer circle at a second distance R2 from the patch center point 21.

The loop section 100 is formed on the upper surface of the supporter 30 at a predetermined distance G from the edge of the patch section 20. The distance G of the gap between the loop section 100 and the patch section 20 may be arbitrarily set to a small distance, as long as a value of G is small enough relative to the wavelength of the second frequency f2, and a more concrete value for the distance G may be determined through simulation and/or testing. For example, the distance G may be set to 1/50 or less of the wavelength of the second frequency f2. The width of the loop section 100 may also be arbitrarily set to a small distance, as long as the width is small enough relative to the wavelength of the second frequency f2. A more concrete value of the width of the loop section 100 may be designed.

The feeder line 60 in the fifth modification is so configured to supply an electric power to the loop section 100. One end of the feeder line 60 is electrically connected with the inner conductor of the coaxial cable, and the other end of the feeder line 60 is formed on the upper surface of the supporter 30 so that an inductive (i.e., electromagnetic) coupling with the loop section 100 may be made. The electric current input from the feeder line 60 propagates to the patch section 20 via the loop section 100, and excites the patch section 20. One end of the feeder line 60 close to the loop section 100 is designated as the loop side end. In the loop section 100, the point closest to the loop side end of the feeder line 60 functions as a feeding point 101.

In the present embodiment, the feeder line 60 is so arranged that the feeding point 101 is positioned on an extension line of the sub-patch border line. Using such configuration, the electric current from the feeder line 60 can be supplied to the plurality of sub-patch sections 23 simultaneously, that is, in parallel, or at the same time.

Figure 20:
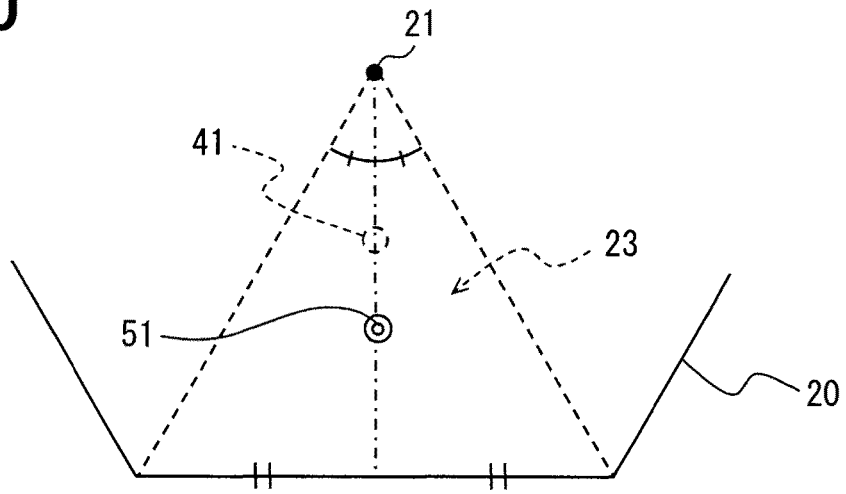
FIG. 20 illustrates an arrangement of the first conductive element and the second conductive element in a sub-patch section.

In this modification, a first conductive element 41 that serves as the first short circuit section 40 is provided for each of the plurality of sub-patch sections 23. As shown in FIG. 20, the first conductive element 41 may be positioned on a line that extends radially from the patch center point 21 and bisects the sub-patch section 23. Such a line may be referred to as a sub-patch bisector. The single-dot-single-dash line in FIG. 20 is a sub-patch bisector.

The first short circuit section 40 may be configured so that the first conductive element 41 is provided only for some of the sub-patch sections 23. That is, some of the sub-patch sections 23 may have no first conductive element 41. The first conductive element 41 may be arranged at equal intervals on the inner circle. The first conductive element 41 may also be arranged at offset positions, that is, at positions not on the sub-patch bisector.

A second conductive element 51 that forms the second short circuit section 50 may also be provided as a conductive element 51 for each of the plurality of sub-patch sections 23, just like the first conductive element 41. The second conductive element 51 may also be positioned on the sub-patch bisector.

Here, in the fifth modification, one first conductive element 41 and one second conductive element 51 are respectively provided in one sub-patch section 23. That is, the first element number M and the second element number N match the number of sub-patch sections 23. Each of the plurality of first conductive elements 41 and second conductive elements 51 are respectively positioned on the sub-patch bisector.

The effects achieved by the above-described embodiment may also be achieved by the configuration of the fifth modification. By using configurations having the loop section 100, the radiation gain for each frequency can be raised. This is because, when the electric power is supplied to the plurality of sub-patch sections 23, the loop section 100 serves as an element that provides (i) a phase matching function for matching the phase of the adjacent sub-patch sections 23, and/or (ii) a phase differentiation function for providing an appropriately-differentiated phase to each of the sub-patch sections 23, to improve the radiation gain of the entire patch section 20.

[Sixth Modification]

Figure 21:
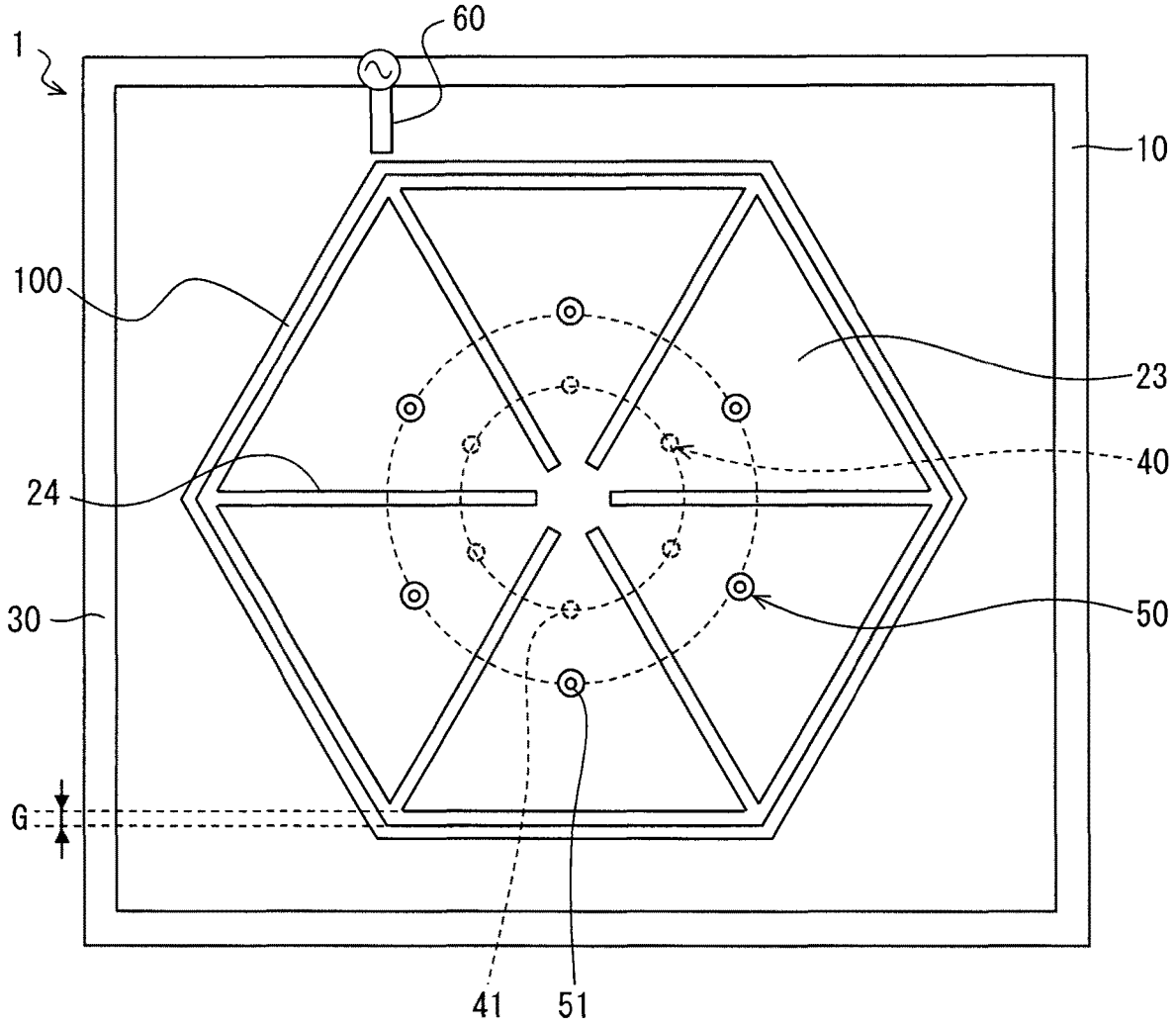
FIG. 21 is a top view of the antenna device in another modification example.

In the configuration of the sixth modification, to widen the operating bandwidth of each of the operation frequencies, e.g., the first frequency f1 and the second frequency f2, a linear slit 24 extending from each vertex on the edge of the patch section 20 toward the patch center point 21 may be provided in the patch section 20, as shown in FIG. 21. The slit 24 provides a configuration that electrically divides the patch section 20 into six sub-patch sections 23.

The slit 24 is a cut extending toward the patch center point 21 from the vertex (i.e. a corner) on the edge of the patch section 20. The slit 24 is cut formed along the sub-patch border lines described in the fifth modification. One end of the slit 24 is connected with the gap between the loop section 100 and the patch section 20. The other end of the slit 24 closest to the patch center point 21 may be designated as the center side end.

The length of the slit 24 may be arbitrarily designed. However, in the configuration of the sixth modification, the distance between the center side end of the slit 24 and the patch center point 21 may, for example, be set to a value of 1/100 of the wavelength of the first frequency f1 or more, so that each of the sub-patch sections 23 are not physically divided from the other sub-patch sections 23. In this case, each of the sub-patch sections 23 is connected to the others around the proximity of the patch central point 21. The width of the slit 24 may be arbitrarily designed. For example, the width of the slit 24 may be set to a value of about 1/10 of the wavelength of the second frequency f2.

According to the configuration of the sixth modification, the operating bandwidth of each of the operation frequencies, that is, the first frequency f1 and the second frequency f2, can be increased. By providing the plurality of slits 24 in the patch section 20, the combination between the sub-patch sections 23 is weakened, which results in a varying amount of electric current flowing from section to section.

As a result, at a certain frequency, a sub-patch section 23 located furthest from the feeding point becomes harder to excite, and the electric field distribution area shrinks in the patch section 20. In other words, at a certain frequency, the plurality of sub-patch sections 23 closest to the feeding point are combined to function as one patch section. The size of the area of these combined sub-patch sections 23 is smaller than the area of the original patch section 20, thereby (i) decreasing the capacitance that contributes to the parallel excitation, and (ii) causing the parallel resonance at a frequency slightly shifted from the intended transmission/reception frequency.

In other words, by providing the slit 24, the combination between the sub-patch sections 23 is less restrained, which makes the excitation easier even at a shifted frequency, i.e., a frequency shifted from the intended transmission/reception frequency. According to such effects, the operating bandwidth at each of the operation frequencies such as the first frequency f1 and the second frequency f2 is increased.

The loop section 100 that supplies the electric current to the patch section 20 is disposed on the outside of all sub-patch sections 23. As such, the loop section 100 enables a combined operation of all the sub-patch sections 23, i.e., an operation of the sub-patch sections 23 combined to function as one patch section 20. That is, it enables an operation at the originally-intended transmission/reception frequency, such as the first frequency f1 and/or the second frequency f2. The combined area as the combination of the sub-patch sections 23 means an electric field distribution area having a certain intensity. In this case, the intensity of the electric field distribution area is relatively strong.

[Seventh Modification]

Figure 22:
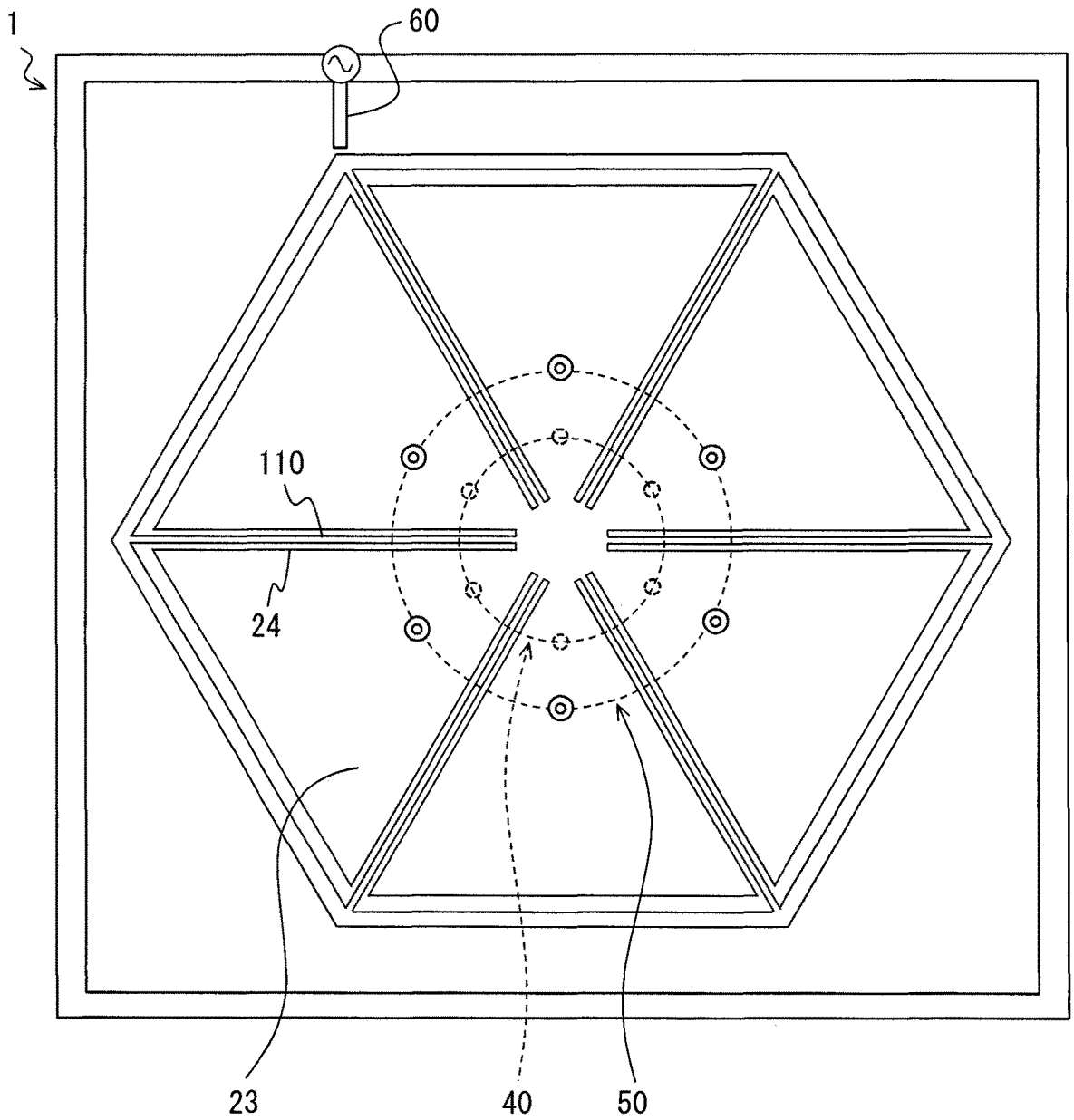
FIG. 22 is a top view of the antenna device in another modification example.

With reference to FIG. 22, the seventh modification of the above-described embodiment includes a linear conductive member 110 or rather a linear element 110 on the center line of each slit 24 that extends from the loop section 100 toward the patch center point 21. The center line of the slit 24 corresponds to the sub-patch border line.

The linear element 110 is on the center line of the slit 24 with one end of the element 110 connected with the loop section 100 and the other end connected with the patch section 20 around the proximity of the patch center point 21. That is, the linear element 110 electrically connects the proximity of the patch center region of the patch section 20 to the loop section 100, while also serving to weaken the capacitive coupling between the sub-patch sections 23. The electric current flowing in the loop section 100 flows into the sub-patch sections 23 not only from the loop section 100, but also from the linear elements 110.

That is, based on the configuration of the seventh modification, the electric current flowing from a feeding point can be easily supplied to the sub-patch sections 23. As such, an upper limit value of the distance G between the loop section 100 and the patch section 20 can be increased compared to the above-described modifications. In other words, because the distance G has less of an influence of the second frequency f2, there are less restrictions on the distance G between the loop section 100 and the patch section 20. In FIG. 22, the reference numbers of some of the elements are omitted to better emphasize the linear element 110.

[Eighth Modification]

Figure 23:
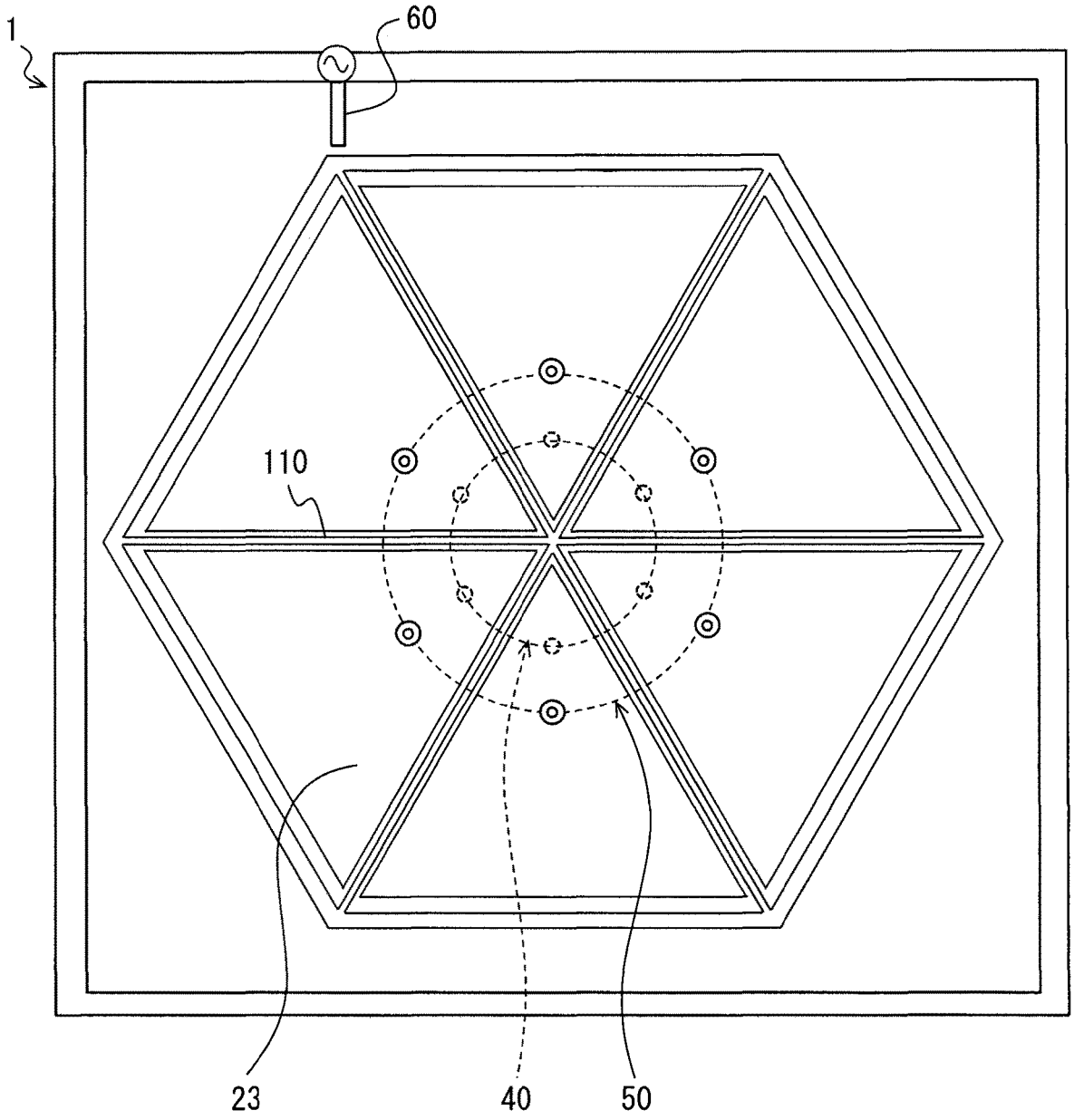
FIG. 23 is a top view of the antenna device in another modification example.

With reference to FIG. 23, the eighth modification shows a further modification to the seventh modification. In the eighth modification, each of the slits 24 extends further toward the patch center point 21 and connects to other slits 24 to separate the sub-patch sections 23 from each other. That is, each of the subdivisions of the patch section 20 functions as the sub-patch sections 23. In FIG. 23, the reference numbers of some of the elements are omitted.

In the configuration of the eighth modification, the patch section 20 is physically divided into the sub-patch sections 23 and every gap between the adjacent sub-patch sections 23 has the linear element 110 extending from the patch center point 21 toward the loop section 100.

Based on the configuration of the eighth modification, the electric current from the feeding point 101 can be easily supplied to the sub-patch sections 23. As such, the distance G between the loop section 100 and the patch section 20 can be increased to a larger value compared to the distance G in the fifth, sixth, and seventh modifications. In other words, in the eighth modification there are less restrictions on the distance G between the loop section 100 and the patch section 20.

[Ninth Modification]

Figure 24:
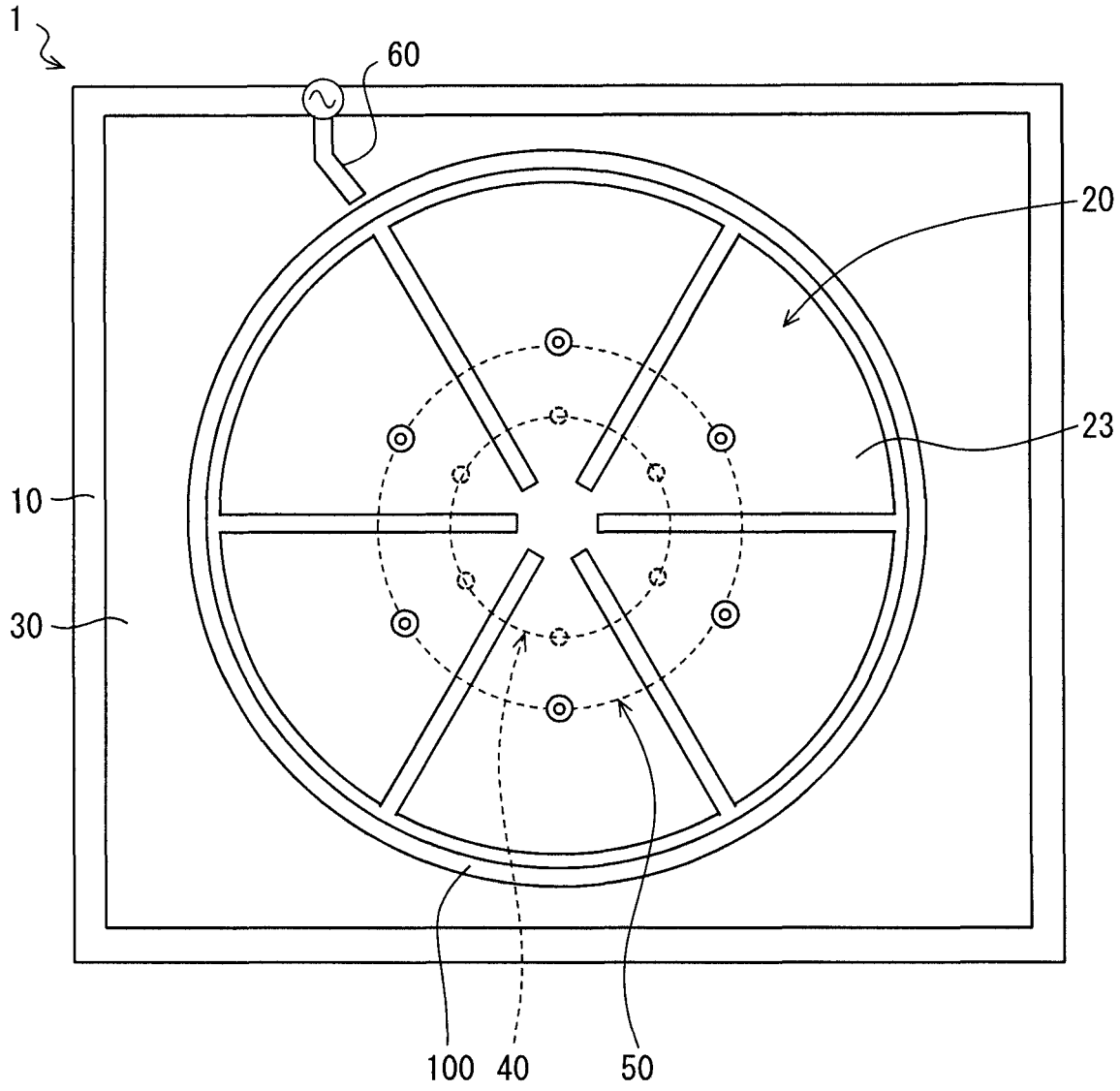
FIG. 24 is a top view of the antenna device in another modification example.

Although the above-described embodiment and modifications describe the patch section 20 having a right hexagonal shape, the shape of the patch section 20 is not limited to such shape. The planar shape of the patch section 20 may also be, for example, a round shape, a right octagonal shape, a square shape, and an equilateral triangle shape. For example, the patch section 20 may have a circular shape as shown in FIG. 24. FIG. 24 illustrates a modification where the planar shape of the patch section 20 is changed to a circular shape. In a circular-shaped patch section 20, the patch section 20 may still be divided into equal sized, pie-shaped sub-patch sections 20 following the teachings of the above-described modifications. That is, the patch section 20 may be subdivided by virtual lines extending from the patch center point 21 to the edge of the patch section 20, by slits 24, or by linear elements 110. Each of the sub-patch sections 23 may have the same size. Although FIG. 24 shows six sub-patch sections 23, the number of the sub-patch sections 23 where the patch section 20 is a circular shape is not limited to such number, and the patch section 20 may be subdivided into four sub-patch sections 23, eight sub-patch sections 23, etc.

Although the present disclosure has been fully described in connection with embodiments and modifications with reference to the accompanying drawings, it is to be noted that various changes and modifications will become apparent to those skilled in the art, and such changes, modifications, and summarized schemes are to be understood as being within the scope of the present disclosure as defined by appended claims.

What is claimed is:

1. An antenna device for receiving and transmitting a radio wave at a first frequency and a second frequency, the second frequency higher than the first frequency, the antenna device comprising:

a ground plate, wherein the ground plate is a first planar conductive member;

a single, continuous patch, wherein the patch is a second planar conductive member and disposed at a preset distance from and parallel to the ground plate, the patch having an edge part and a centrally disposed patch center point;

a plurality of first conductive elements configured to electrically connect the patch and the ground plate, the plurality of first conductive elements spaced at an equal distance from each other and arranged in a first circle with a first radius from the patch center point;

a plurality of second conductive elements configured to electrically connect the patch and the ground plate, the plurality of second conductive elements spaced at an equal distance from each other and arranged in a second circle with a second radius from the patch center point;

a plurality of capacitive elements of a preset capacitance disposed on an electric current path from the patch to the ground plate, a loop section, the loop section being a loop-shaped conductive member on a plane parallel to the ground plate and spaced apart from the edge part of the patch at a preset distance; and a plurality of sub-patch sections, each of the plurality of sub-patch sections being a division of the patch, wherein the second radius is greater than the first radius, all of the plurality of the first and second conductive elements are connected to the patch, the antenna device causes a parallel resonance at a frequency $f_{1x}$ determined by an equation:

$$f_{1x} = \frac{1}{2\pi\sqrt{L_1(C_{p1} + NC_x)}},$$

the loop section has a feeding point configured to electrically connect to a feeder line, each of the plurality of sub-patch sections is of an equal size to other sub-patch sections, adjacent sub-patch sections are separated by a linear-shaped slit in the patch that extends a preset length from the edge part toward the patch center point, and at least one of the plurality of the first conductive elements and at least one of the plurality of the second conductive elements are disposed in each of the plurality of sub-patch sections.

2. The antenna device of claim 1 further comprising:

a linear element, the linear element being a linear-shaped conductive member that extends along a center line of the slit for connecting the loop section to the patch.

3. The antenna device of claim 1, wherein the edge part of the patch has a feeding point configured to electrically connect to a feeder line.

4. The antenna device of claim 1, wherein a quantity of the plurality of the first conductive elements is equal to a quantity of the plurality of the second conductive elements, and wherein the plurality of the second conductive elements are angularly offset from the plurality of the first conductive elements so that a line extending radially from the patch center to the first circle and the second circle and intersecting one of the plurality of the first conductive elements does not intersect any of the plurality of the second conductive elements.

5. The antenna device of claim 1, wherein the plurality of the capacitive elements are capacitors, and wherein one end of each of the plurality of the second conductive elements is connected to the ground plate, and wherein another end of each of the plurality of the second conductive elements is connected to the patch via one of the plurality of the capacitors.

6. The antenna device of claim 1, wherein the plurality of the capacitive elements are conductive plates, each of the plurality of the conductive plates having a predetermined size, disposed in between the ground plate and the patch, and facing the patch at a predetermined distance from the patch, and wherein one end of each of the plurality of the second conductive elements is connected to the ground plate, and wherein another end of each of the plurality of the second conductive elements is connected to one of the plurality of the conductive plates, and wherein a capacitance formed between one of the plurality of the conductive plates and the patch is based on the predetermined size of the conductive plate and the predetermined distance of the conductive plate from the patch.

7. The antenna device of claim 1, wherein a quantity of the plurality of the first conductive elements is at least three, and wherein a quantity of the plurality of the second conductive elements is at least three.

8. The antenna device of claim 1, wherein the plurality of the capacitive elements are configured to produce a resonant frequency that is determined by (i) the capacitance of the plurality of the capacitive elements and (ii) an inductance of the second conductive element higher than the first frequency.

9. The antenna device of claim 1, wherein the plurality of the capacitive elements includes at least one first capacitive element disposed on a first current path via the first conductive element from the patch to the ground plate to provide a first preset capacitance; and a second capacitive element disposed on a second current path via the second conductive element from the patch to the ground plate to provide a second preset capacitance.

* * * * *